US008196921B1

(12) United States Patent
Opfer et al.

(10) Patent No.: US 8,196,921 B1
(45) Date of Patent: Jun. 12, 2012

(54) SHEET HANDLING DEVICE

(75) Inventors: Shamai Opfer, Mazkeret Batya (IL); Itzik Kent, Ness Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 13/015,659

(22) Filed: Jan. 28, 2011

(51) Int. Cl.
*B65H 29/00* (2006.01)

(52) U.S. Cl. ..... 271/185; 271/186

(58) Field of Classification Search ..... 271/185, 271/186

See application file for complete search history.

(56) References Cited

U.S. PATENT DOCUMENTS 4,019,435 A * 4/1977 Davis ..... 101/232
5,362,039 A 11/1994 Kusters
5,415,385 A * 5/1995 Newsome et al. ..... 270/58.25
6,409,008 B1 * 6/2002 Newsome ..... 198/403
2008/0068432 A1 3/2008 Sohn et al.

* cited by examiner

*Primary Examiner* — David H Bollinger

(57) ABSTRACT

In one example, a sheet handling device includes: a first mechanism configured to receive a flexible sheet moving in a first direction in a first orientation and turn the sheet to a second direction; a second mechanism configured to receive the sheet moving in the second direction, turn the sheet to a third direction and simultaneously reorient the sheet to a second orientation; and a third mechanism configured to receive the reoriented sheet moving in the third direction and turn the sheet to a fourth direction. The second mechanism may include, for example, a trio of elongated rollers and an endless loop belt wrapping the trio of rollers to form a nip between the belt and one of the rollers for receiving a first leading edge of the sheet in the second direction and expelling a second leading edge of the sheet in the third direction.

17 Claims, 26 Drawing Sheets

SHEET HANDLING DEVICE

BACKGROUND

In-line finishing devices for sheet fed printers may sometimes require re-orienting printed sheets for finishing or stacking. For example, sheets printed in a portrait orientation must be reoriented before presenting the sheets to a finishing device or stacker that requires a landscape orientation. In one conventional technique for reorienting print media sheets, a finger protruding into the media path blocks one corner of the moving sheet, causing the sheet to rotate about that corner as it moves past the protruding finger. While this technique may be satisfactory for smaller sheets, up to A4 size sheets for example, it does not work well for larger sheets. Larger sheets of flexible print media tend to collapse or buckle at the point of impact with the finger. In one conventional technique for reorienting larger sheets of print media, the sheet moves on to a table that is rotated to the desired orientation. Such rotating tables project a large horizontal "footprint" and thus occupy a comparatively large amount of floor space. Conventional rotating tables may also be disadvantageous due to the need to vary the speed of the sheets as they move from the printer on to the table, where each sheet stops as the table is rotated, and then accelerated as the sheets are moved off the table to the finisher.

DRAWINGS

Each of FIGS. 8A-8I, 9A-9I, 10A-10I, and 11A-11I are left side elevation, front elevation, right side elevation and plan views, respectively, showing the sequence of a sheet moving through the sheet handling device of FIGS. 1-4. The position of the sheet in each of FIGS. 8A-8I, 9A-9I, 10A-10I, and 11A-11I corresponds to the position of the sheet in the respective FIGS. 7A-7I.

Figure 12:
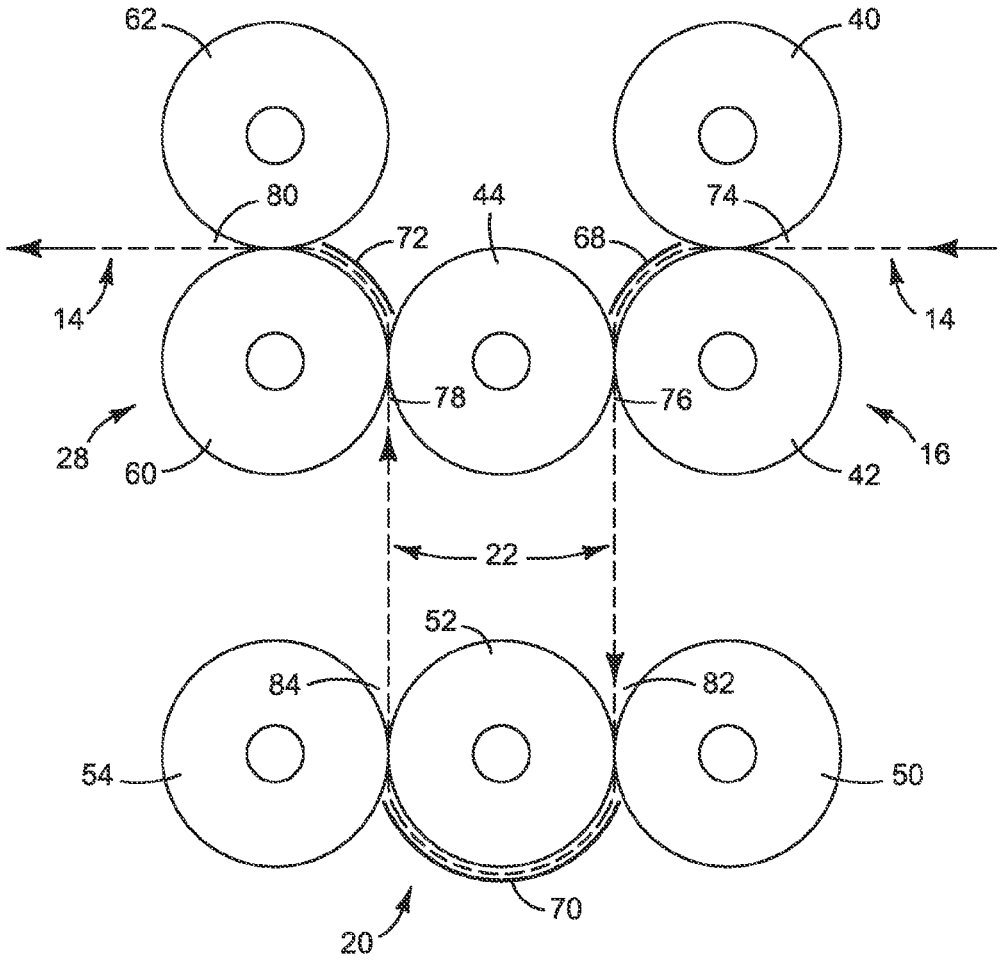

FIG. 12 is an elevation view illustrating a sheet handling device according to another example of the invention.

Figure 13:
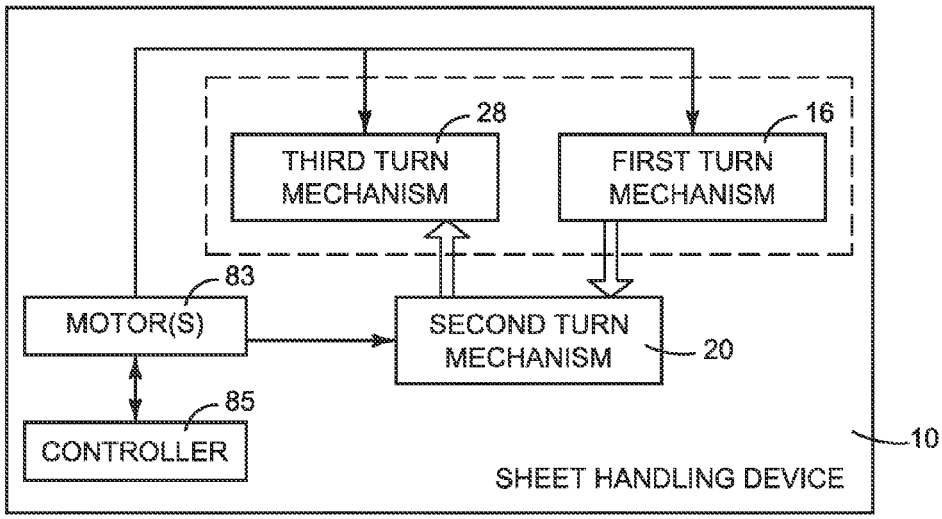

FIG. 13 is a block diagram illustrating a sheet handling device according to one example of the invention.

Figure 14:
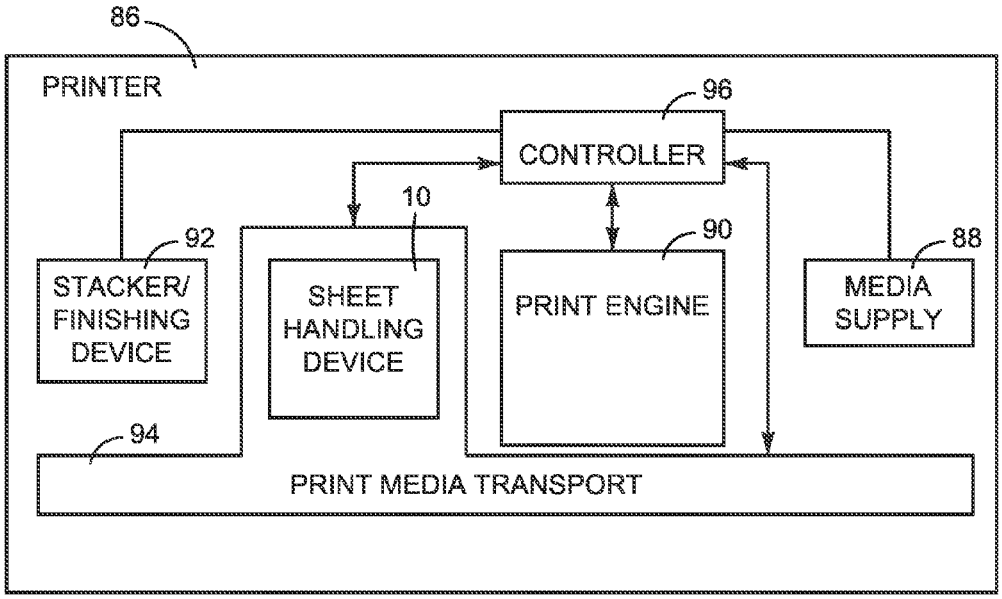

FIG. 14 is a block diagram illustrating a printer implementing a sheet handling device according to one example of the invention.

Figure 15:
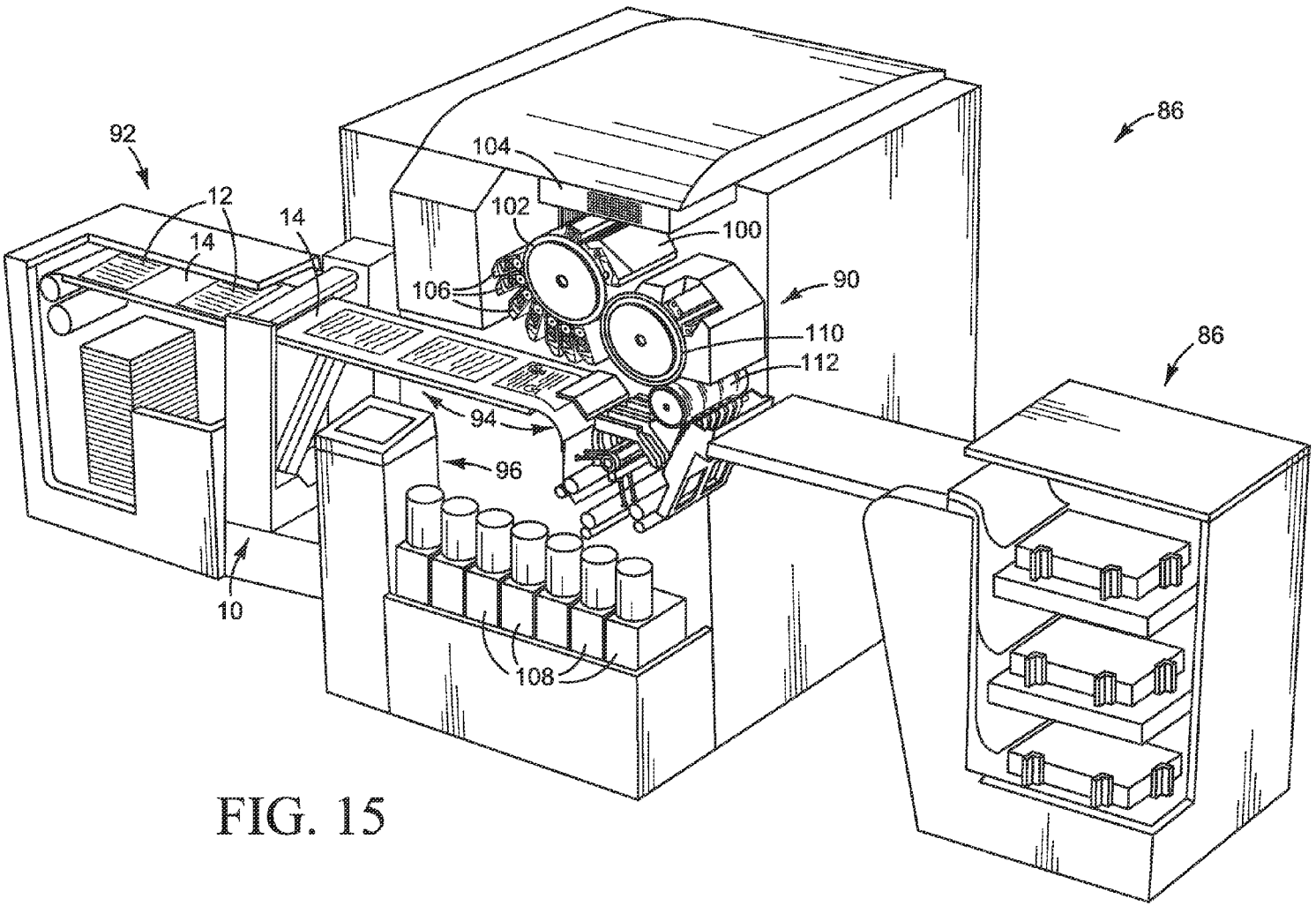

FIG. 15 is a perspective view illustrating a printer, such as the printer shown in the block diagram of FIG. 14, implementing a sheet handling device according to one example of the invention.

The same part numbers are used to designate the same or similar parts throughout the figures.

DESCRIPTION

Examples of the present invention were developed in an effort to more effectively reorient larger print media sheets while minimizing the footprint of the device. Thus, in one example of the invention, a new sheet handling device includes a first turn mechanism configured to receive a flexible print media sheet moving along a horizontal path in a portrait orientation and turn the sheet vertically downward toward a second turn mechanism. The second turn mechanism is configured to rotate the sheet to a landscape orientation and simultaneously turn the sheet vertically upward toward a third turn mechanism. The third turn mechanism is configured to turn the reoriented sheet back to the horizontal path. The reorienting second mechanism may include, for example, a trio of elongated rollers arranged diagonally across the sheet path. An endless loop belt wraps the trio of rollers to form a nip between the belt and one of the rollers. A first, portrait leading edge of the sheet is drawn into the nip and a second, landscape leading edge of the sheet is expelled from the nip. Utilizing such a set of diagonal rollers in a vertical turn path to reorient the sheet makes it possible to handle larger sheets with minimal added footprint.

This is just one example. The invention is not limited to use with print media or printers, nor is it limited to the other specific details mentioned. The examples in this Description should not be construed to limit the scope of the invention, which is defined in the Claims that follow the Description.

Figure 1:
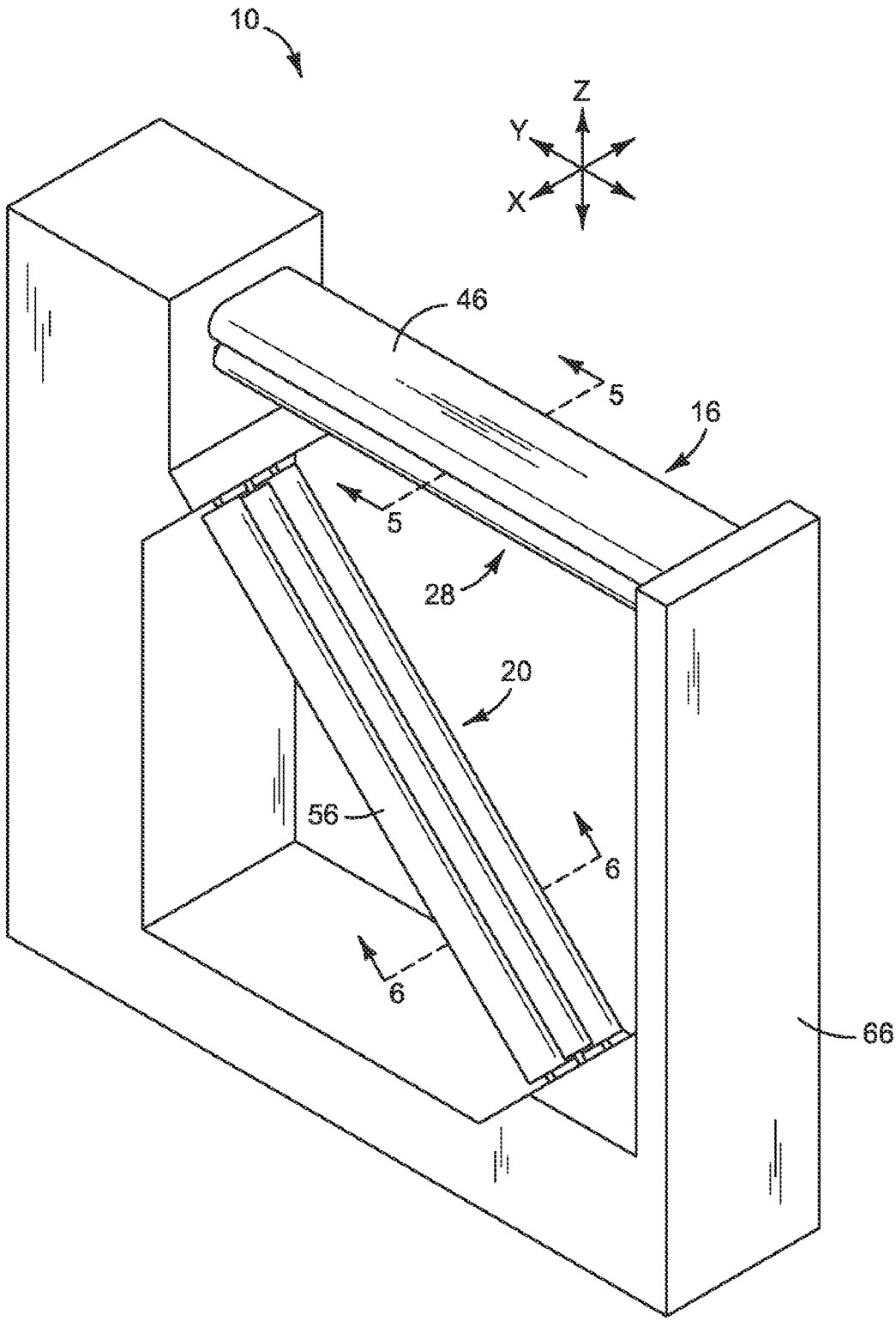
FIG. 1 is a perspective view illustrating a sheet handling device according to one example of the invention.
Figure 2:
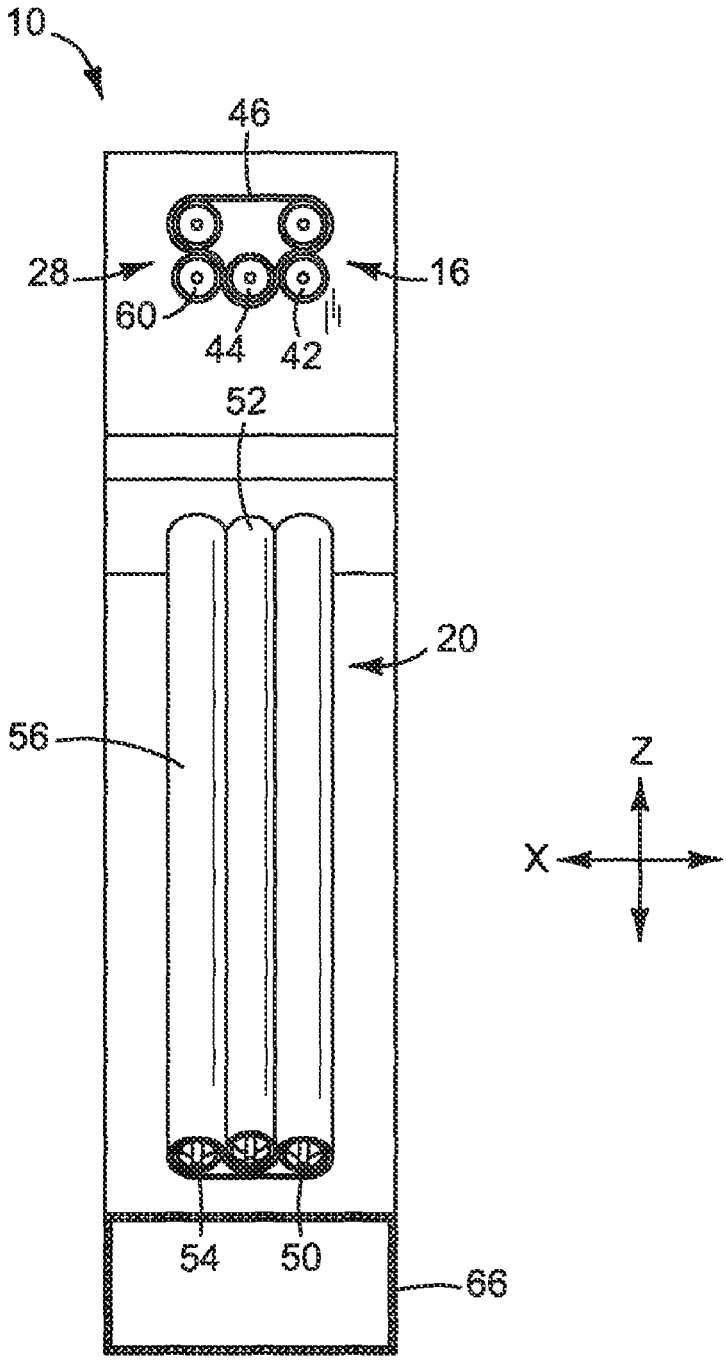
FIG. 2 is a front elevation view of the sheet handling device of FIG. 1.
Figure 3:
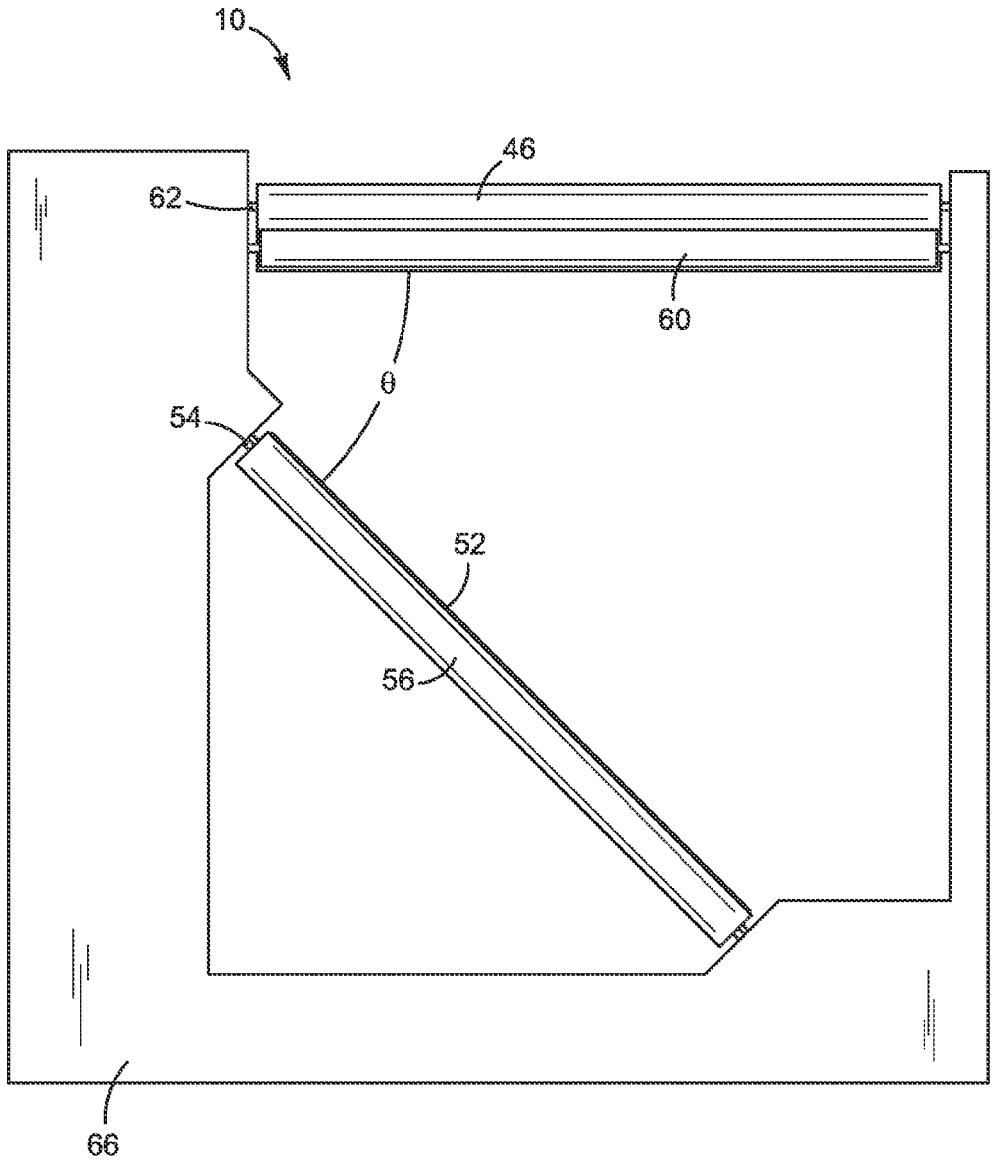
FIG. 3 is a side elevation view of the sheet handling device of FIG. 1.
Figure 3:
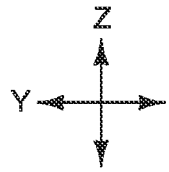
Figure 4:
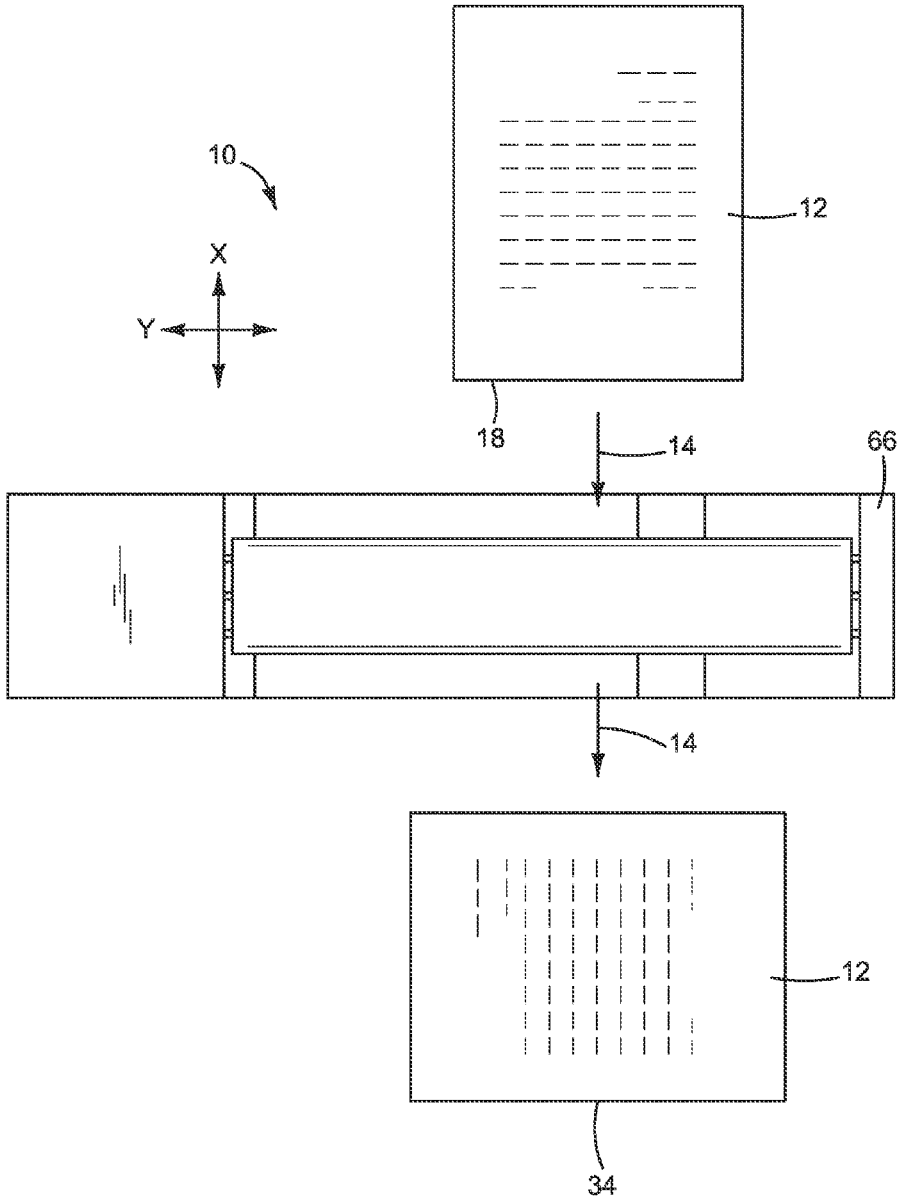
FIG. 4 is a plan view of the sheet handling device of FIG. 1.
Figure 5:
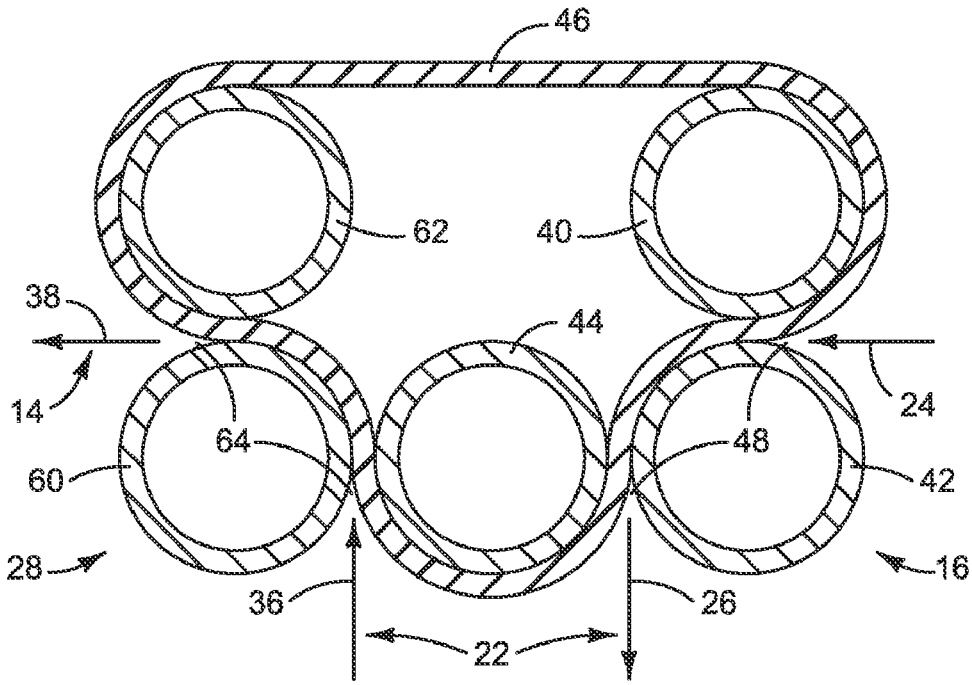
FIG. 5 is a section view of the upper turn mechanism in the sheet handling device of FIGS. 1-4, taken along the line 5-5 in FIG. 1.
Figure 6:
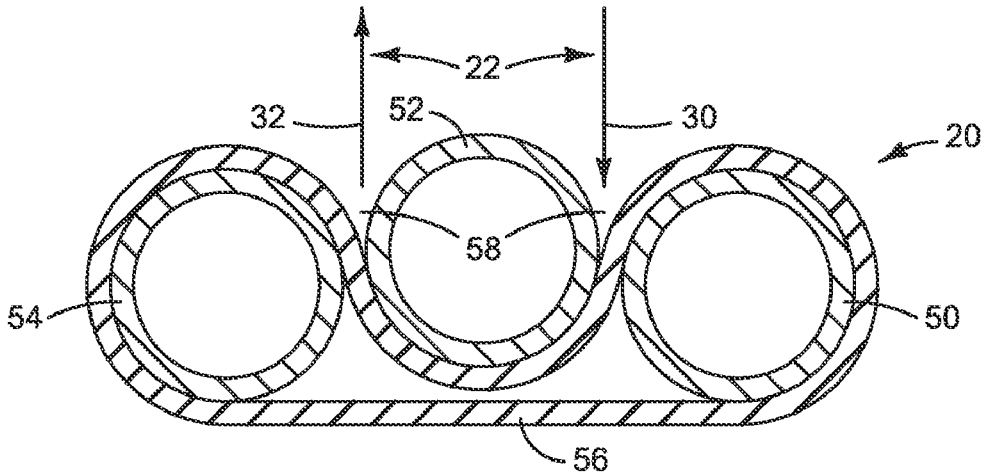
FIG. 6 is a section view of the lower turn mechanism in the sheet handling device of FIGS. 1-4, taken along the line 6-6 in FIG. 1.
Figure 7A:
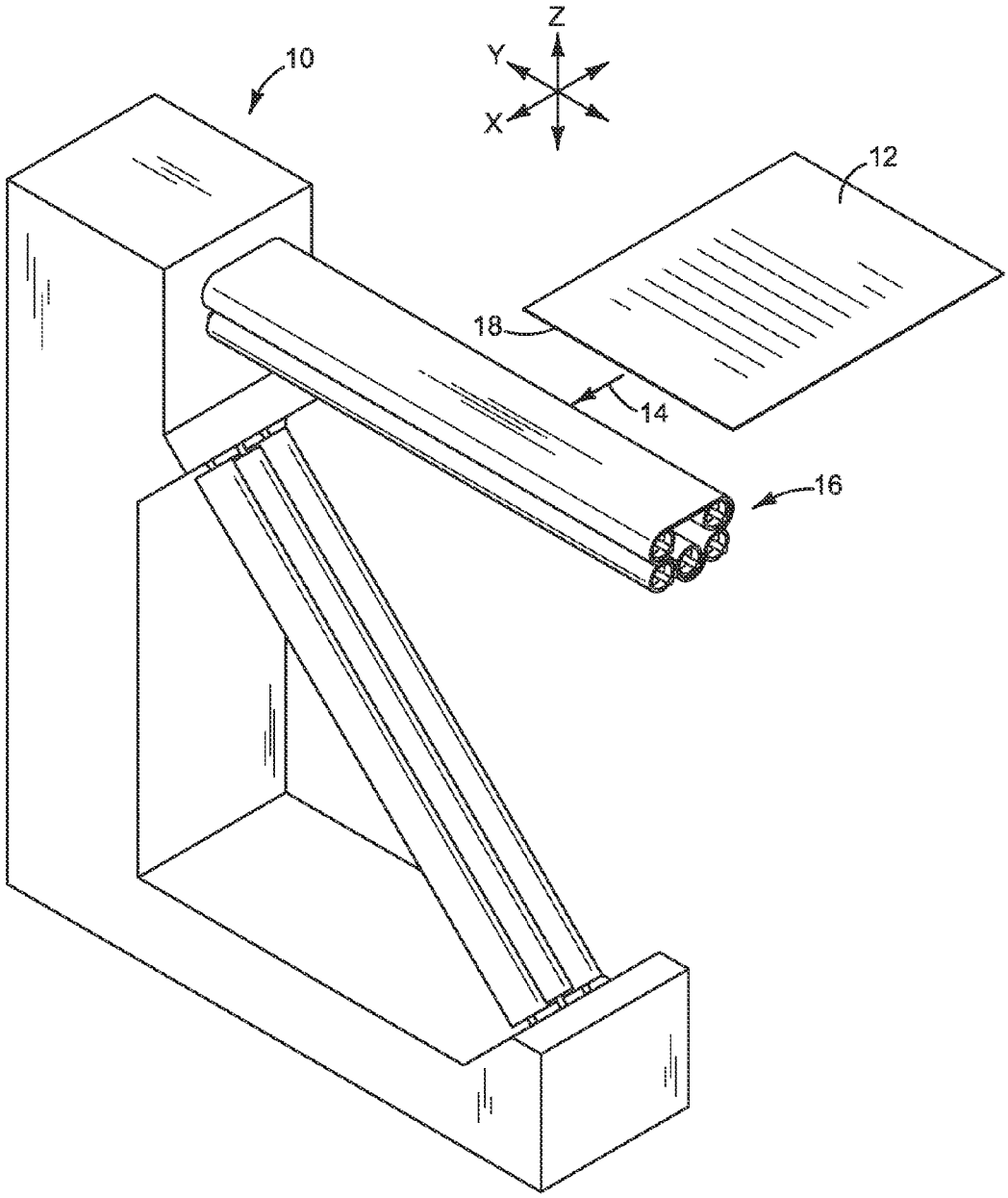
FIGS. 7A-7I are perspective views showing the sequence of a sheet moving through the sheet handling device of in FIGS. 1-4.
Figure 7B:
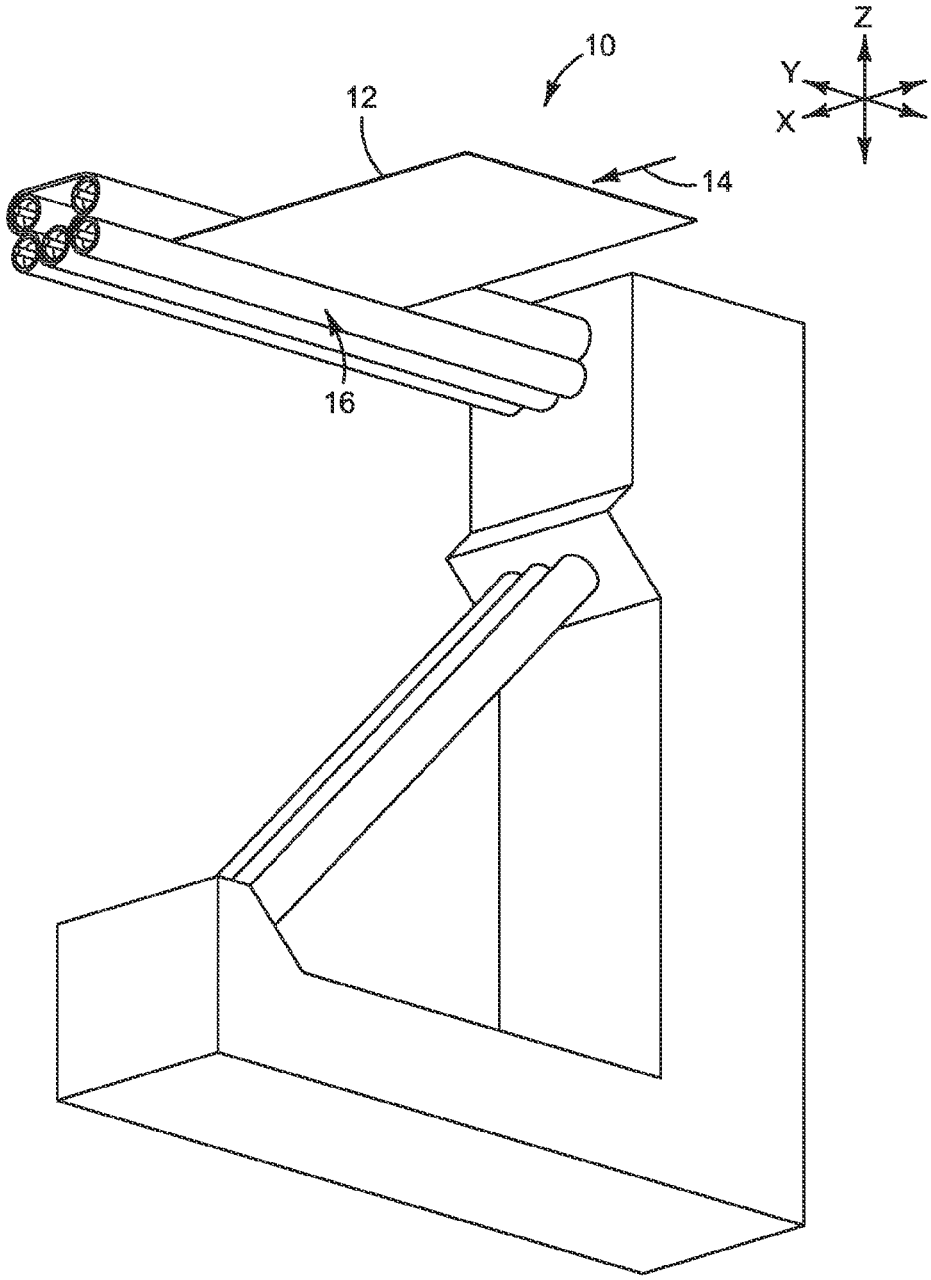
Figure 7C:
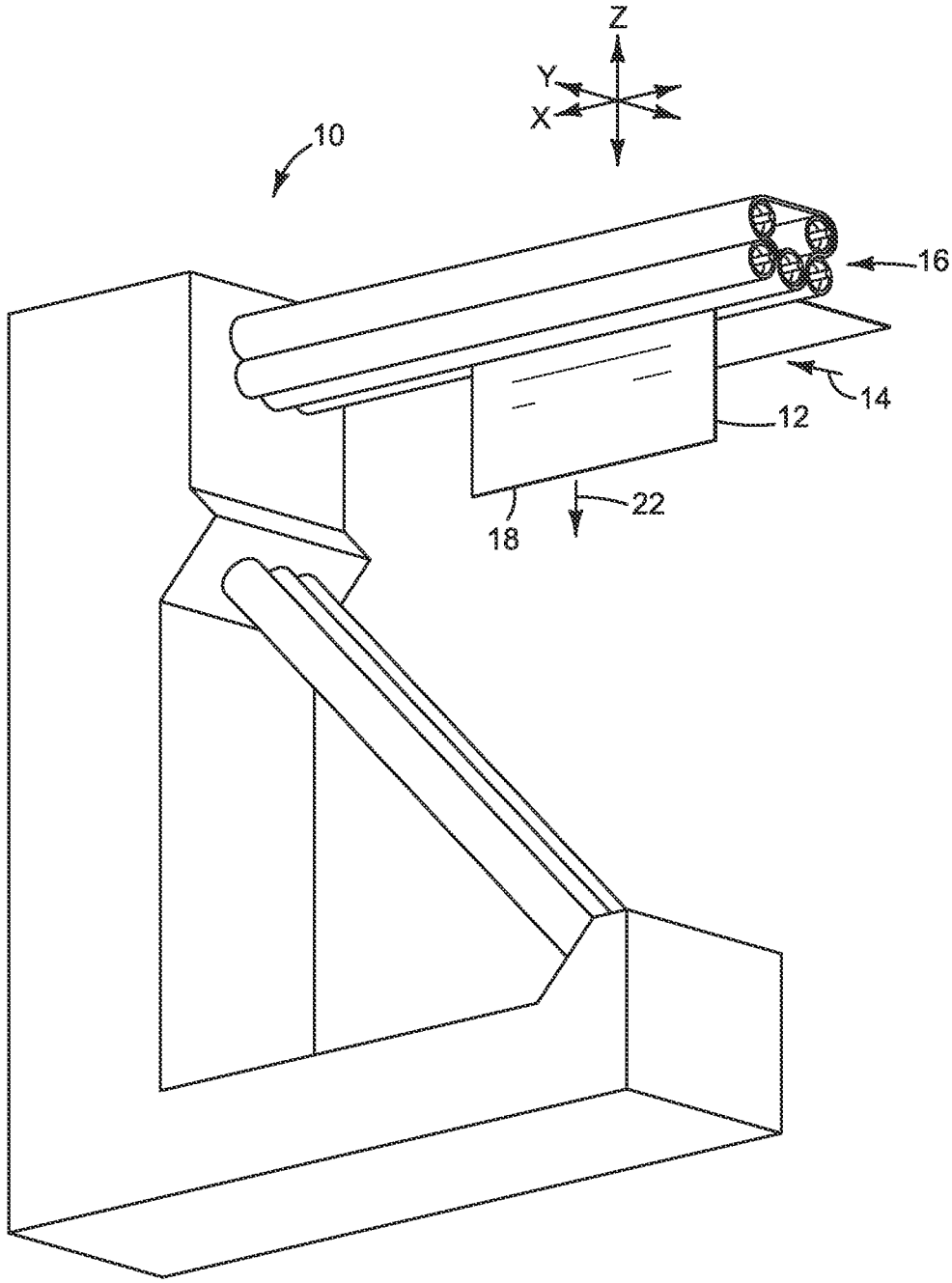
Figure 7D:
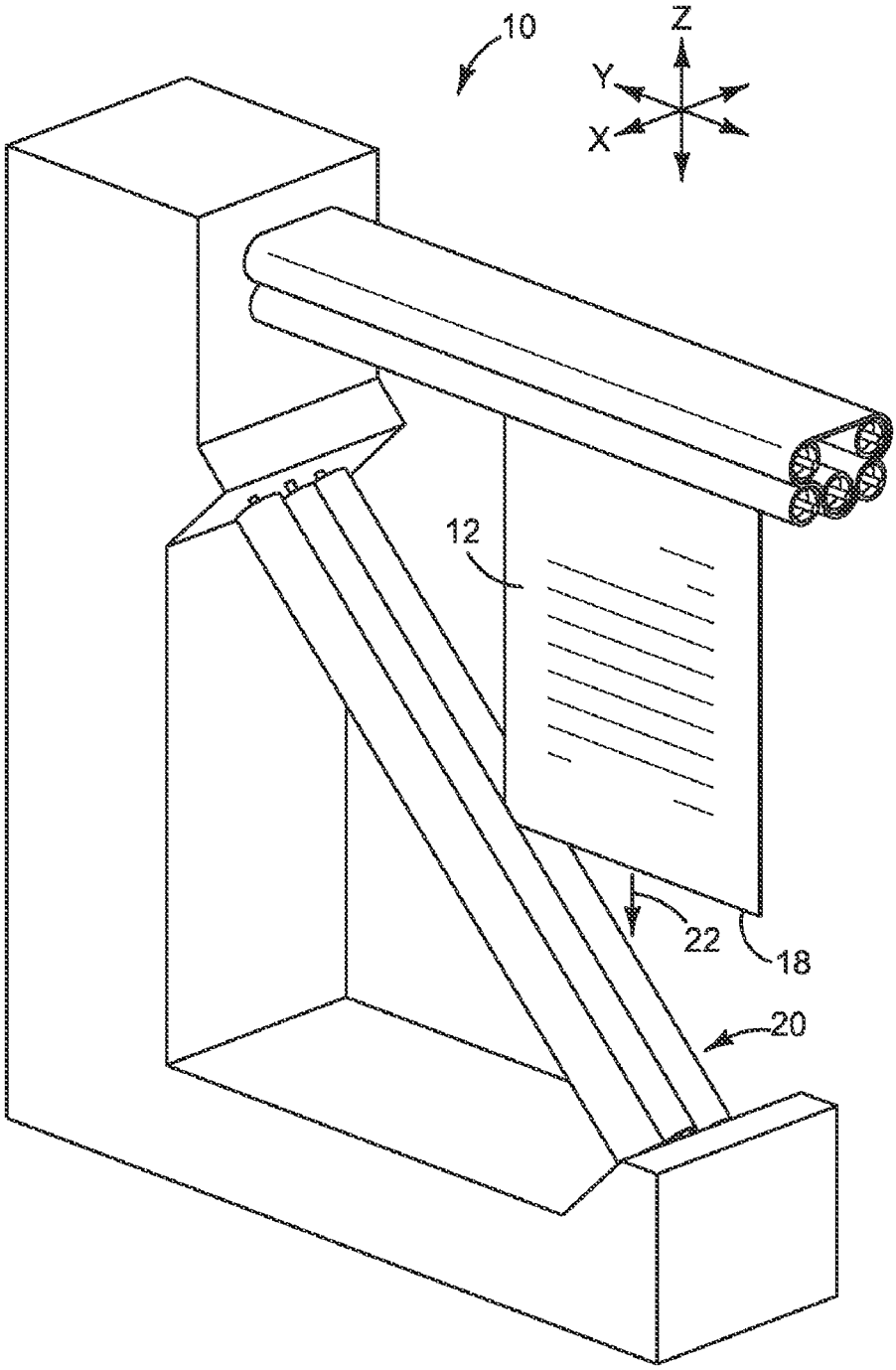
Figure 7E:
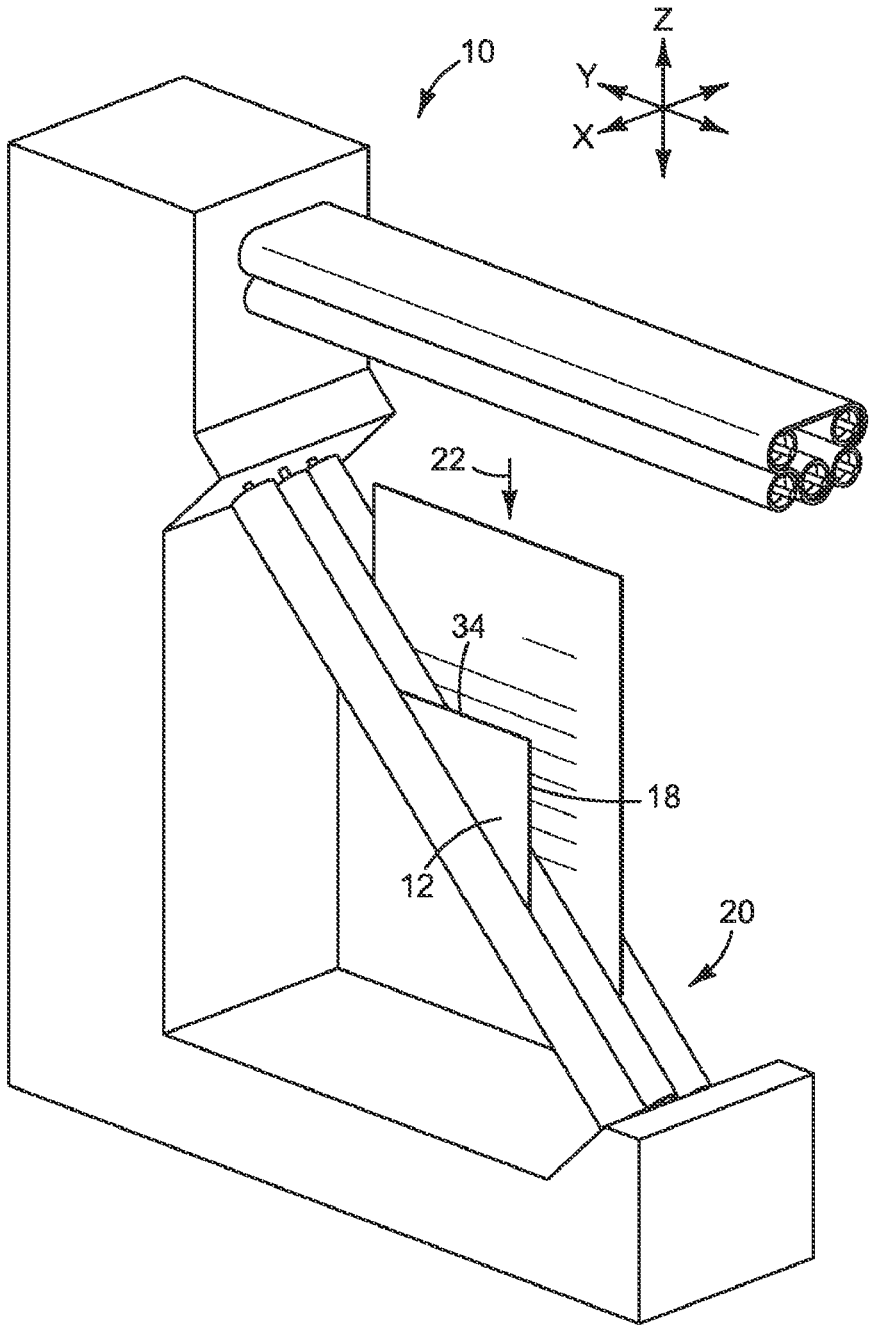
Figure 7F:
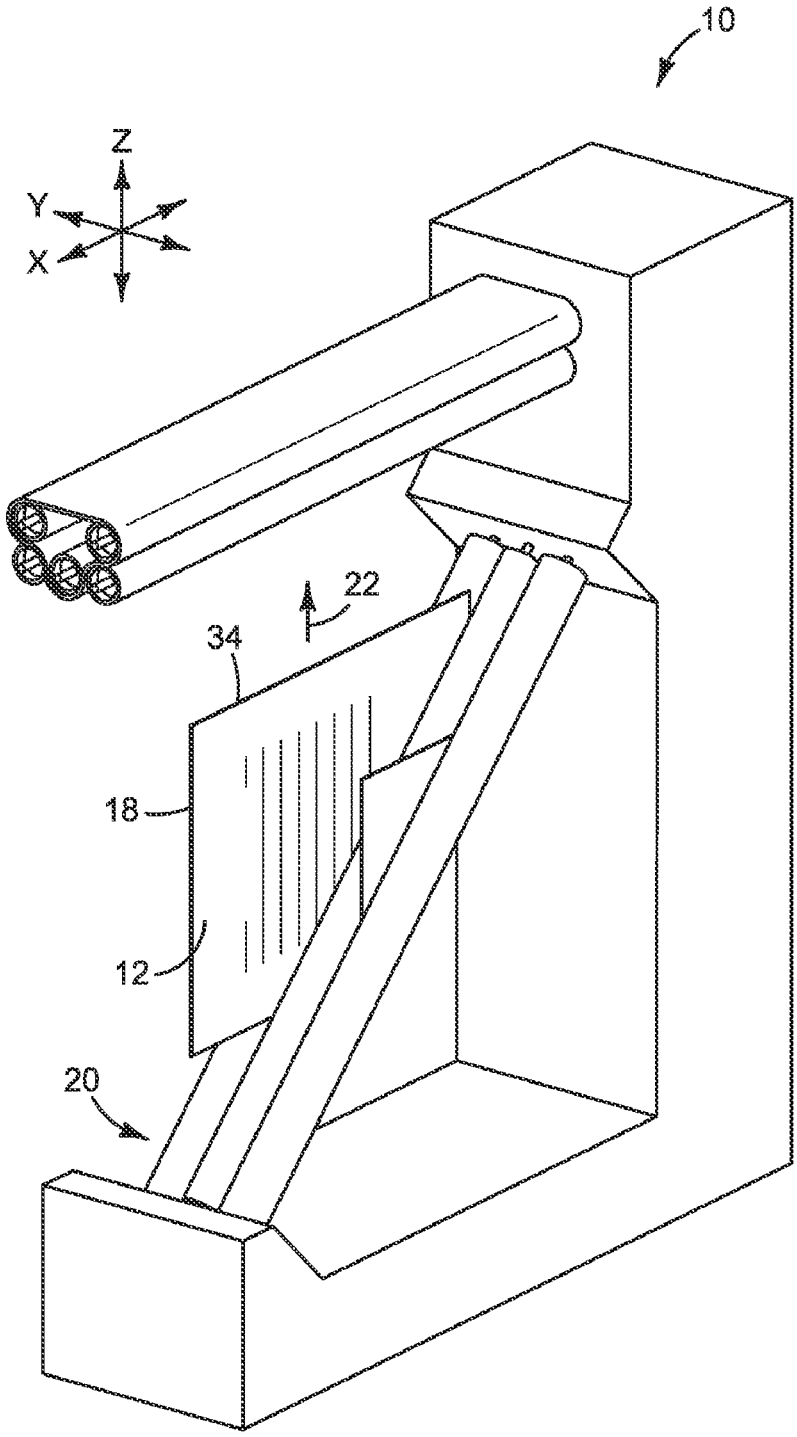
Figure 7G:
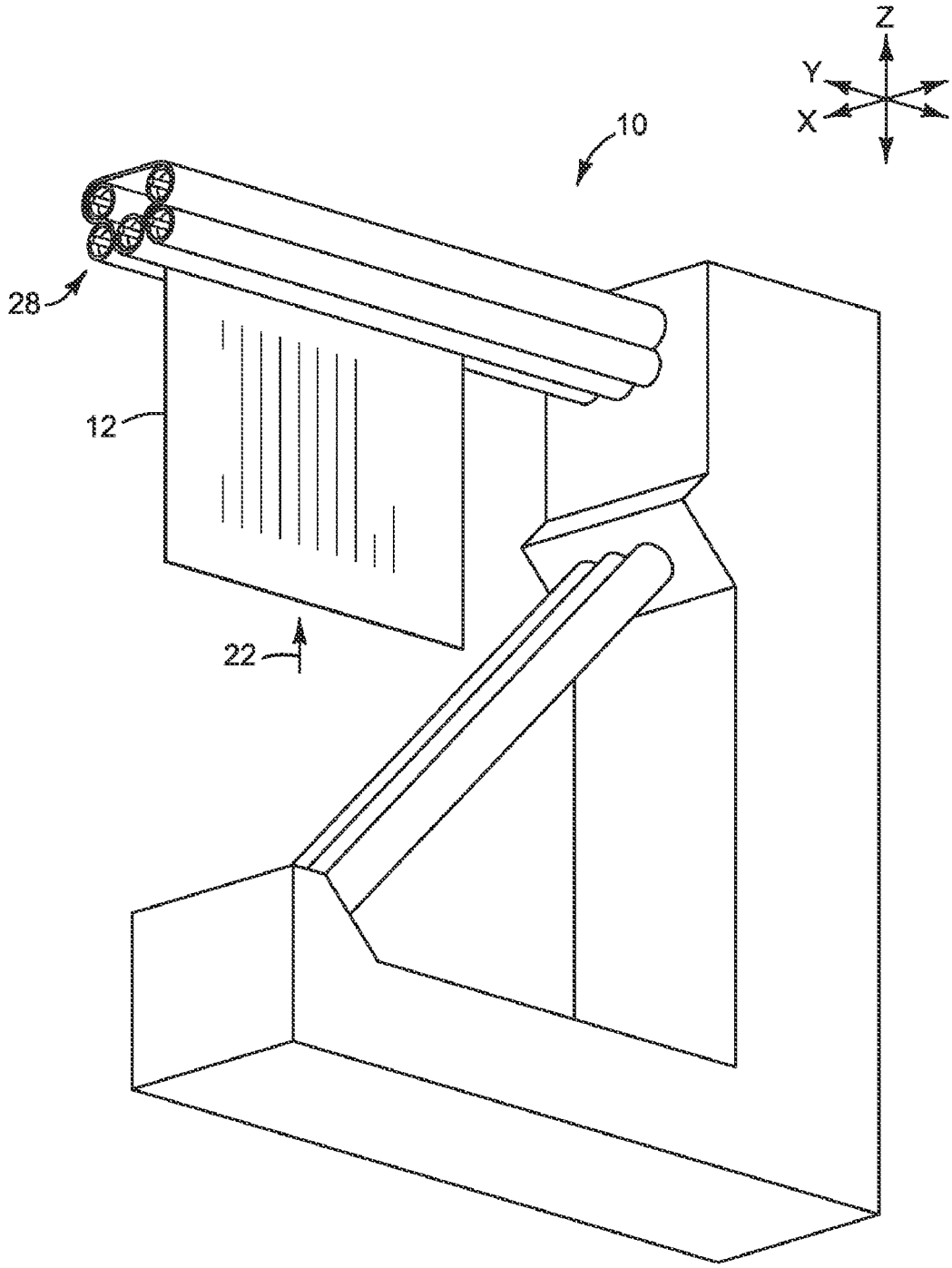
Figure 7H:
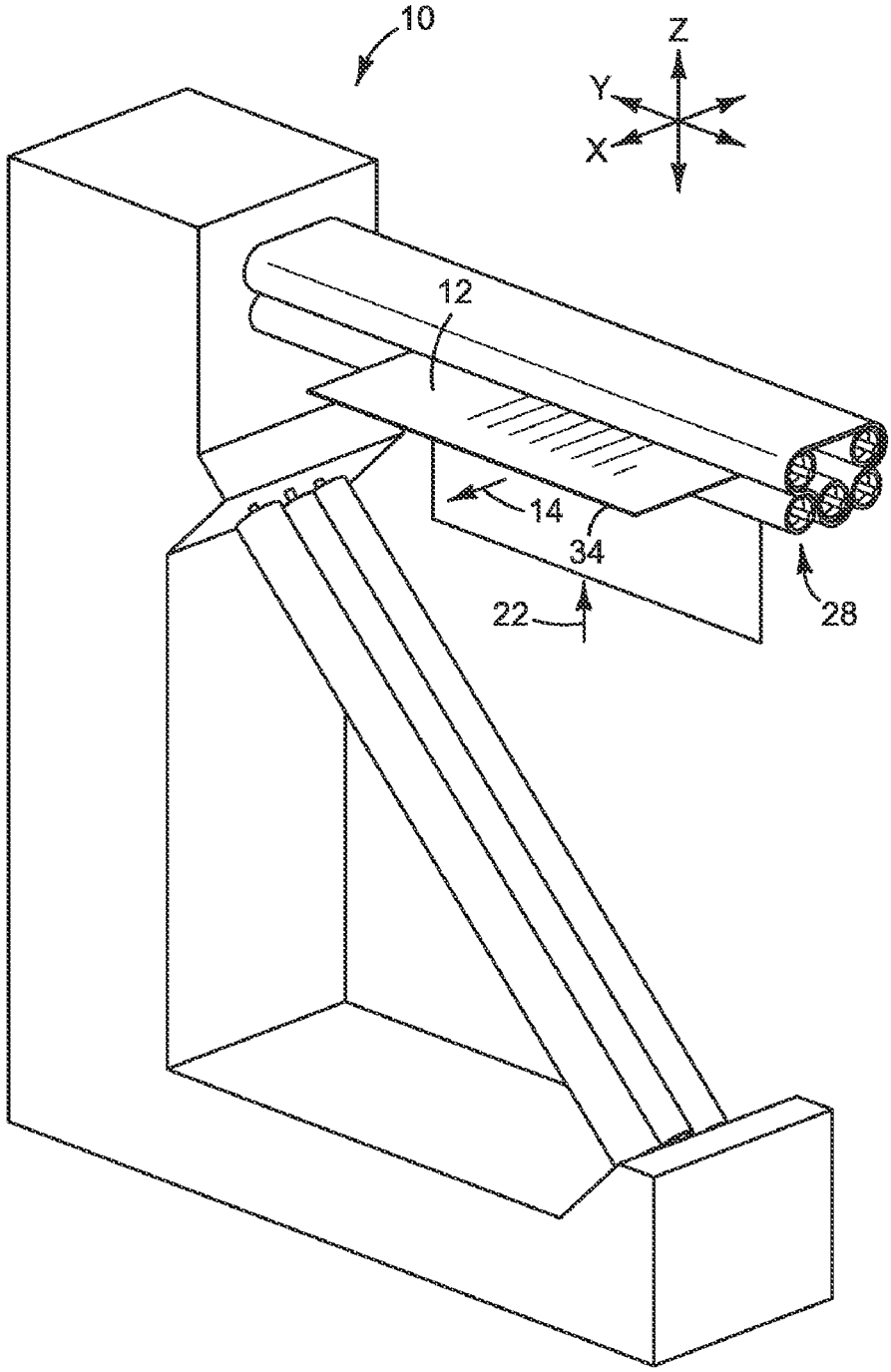
Figure 7I:
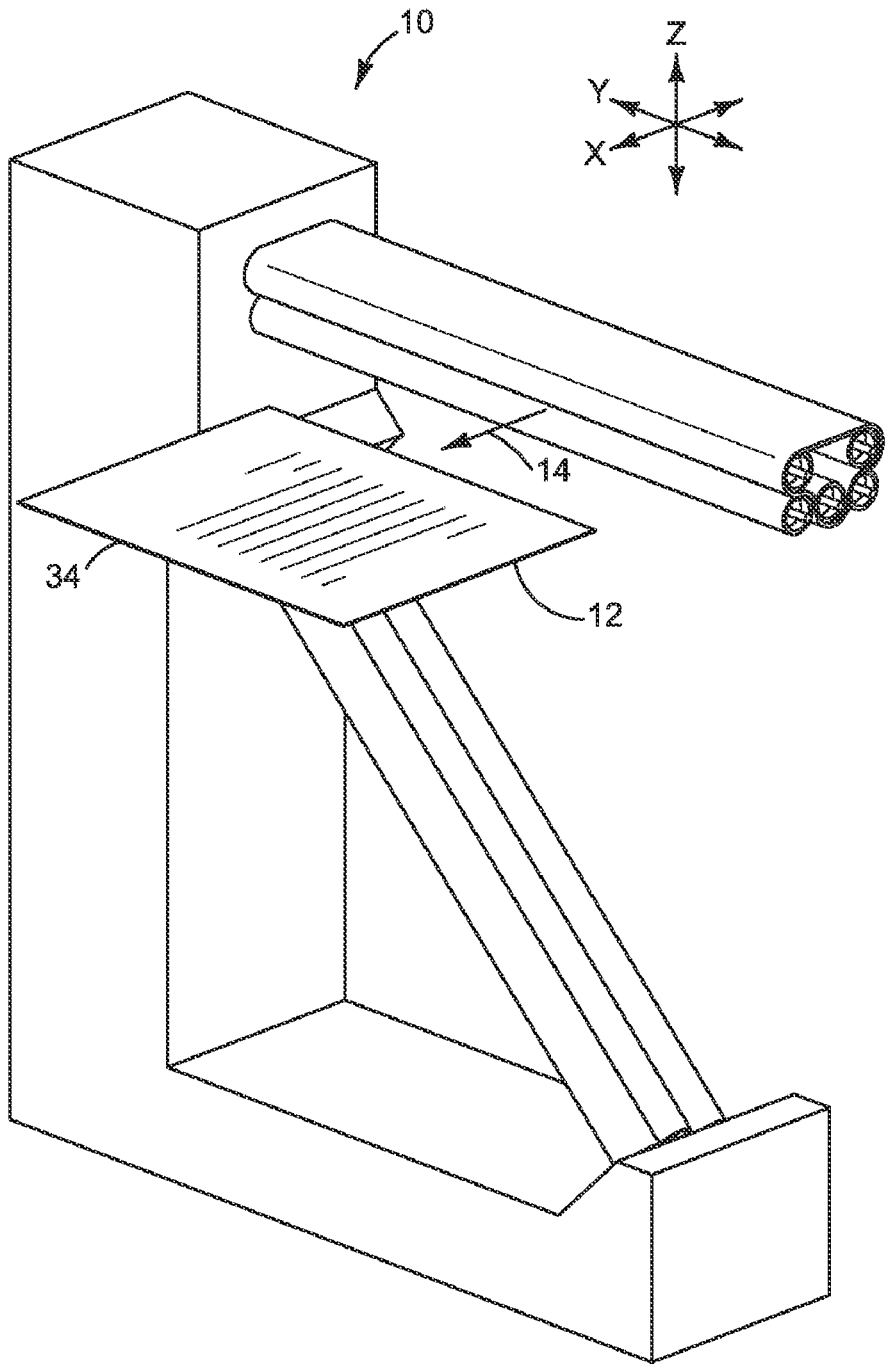
Figures 8A, 9A, 10A, 11A:
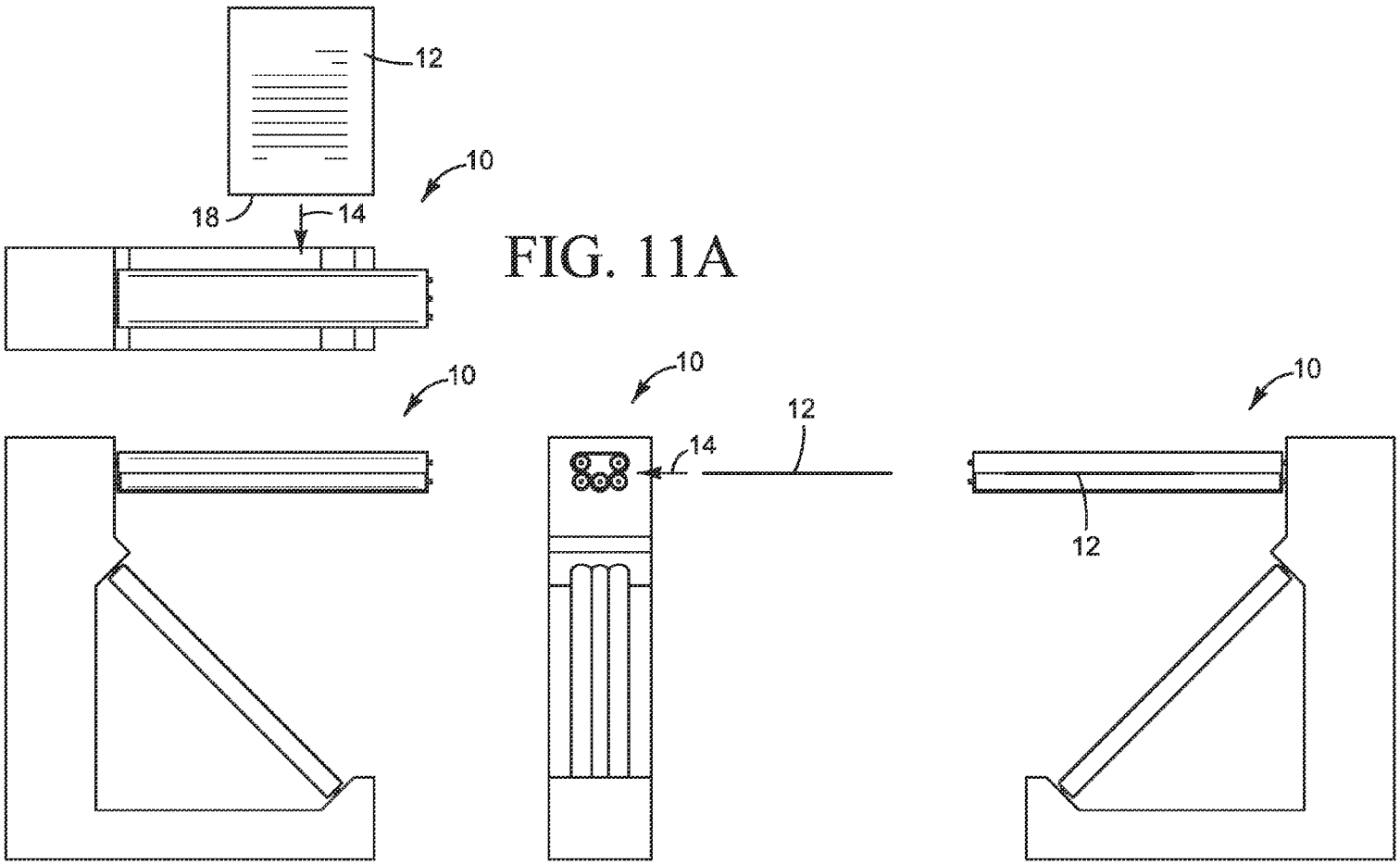
Figure 10B:
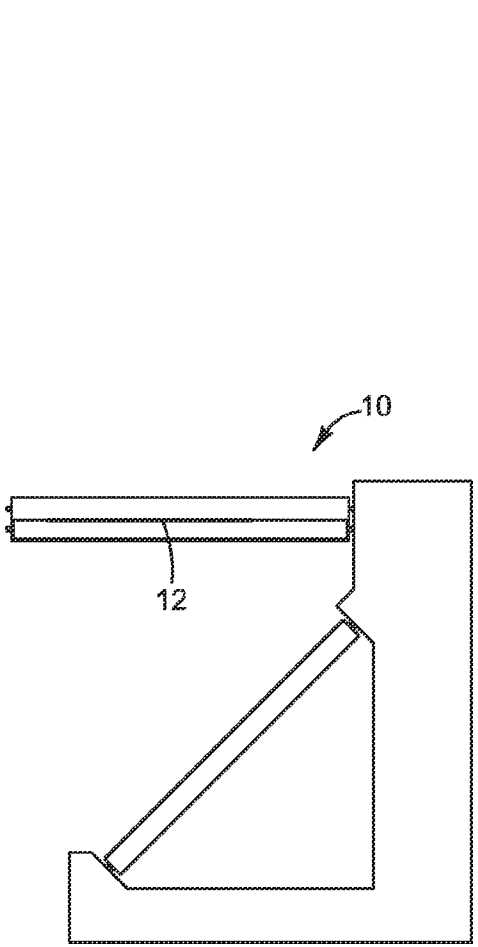
Figure 9B:
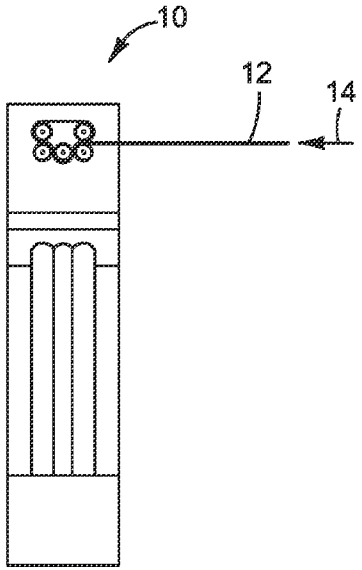
Figure 11B:
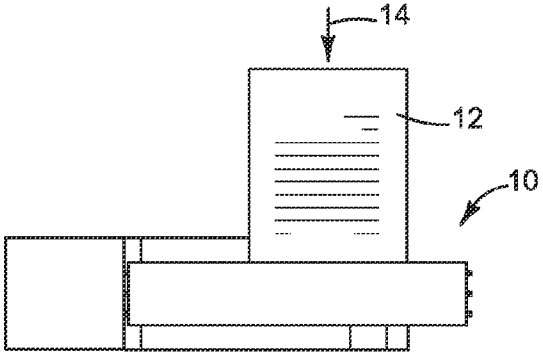
Figure 8B:
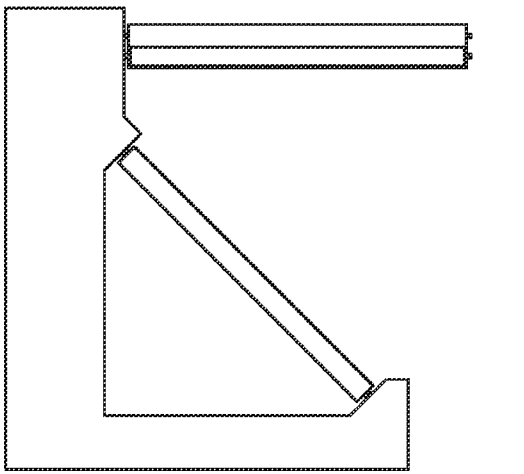
Figure 11C:
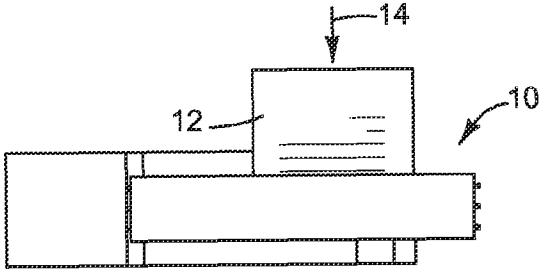
Figure 9C:
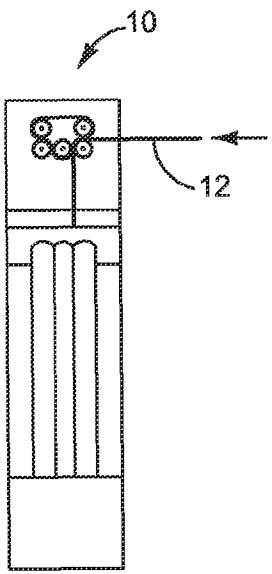
Figure 10C:
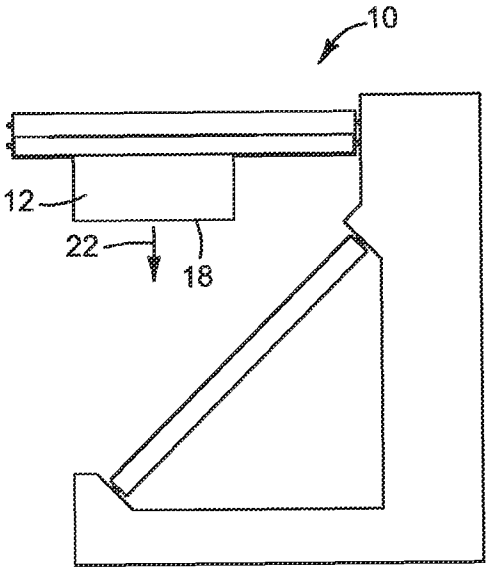
Figure 8C:
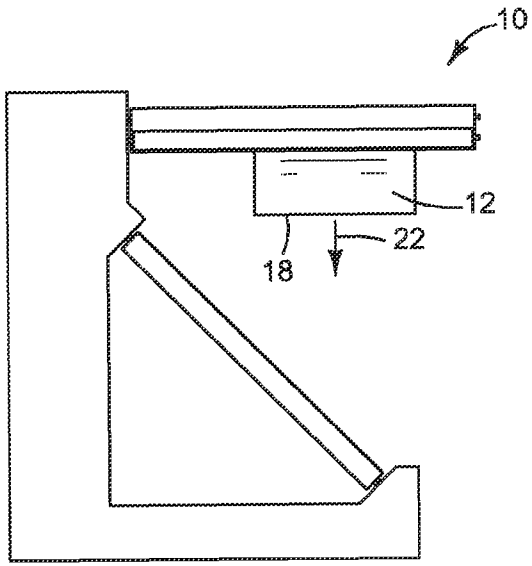
Figure 10D:
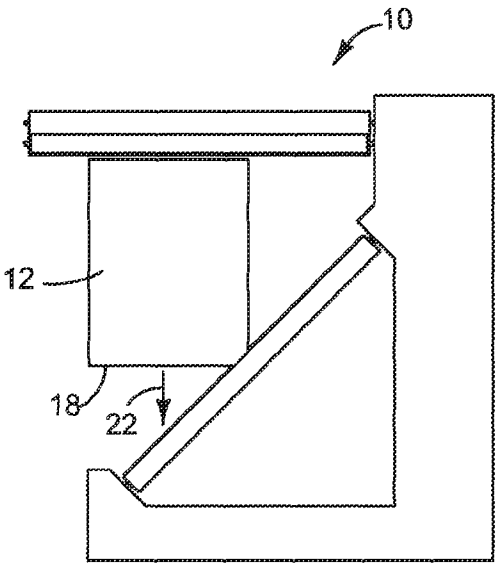
Figure 9D:
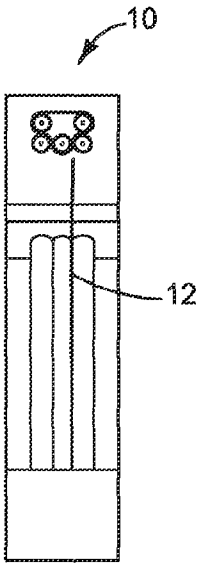
Figure 11D:
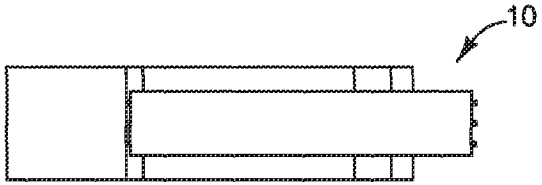
Figure 8D:
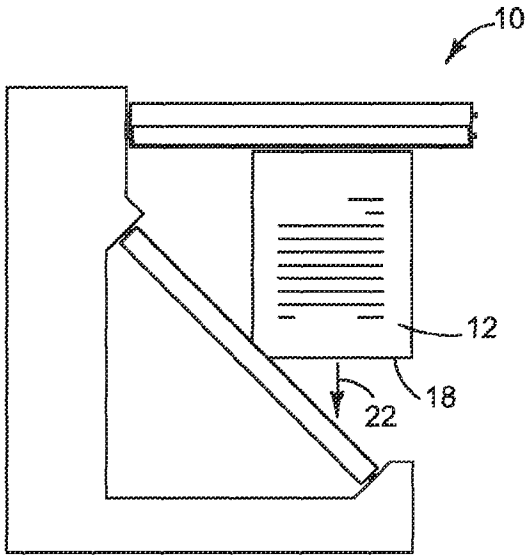
Figure 10E:
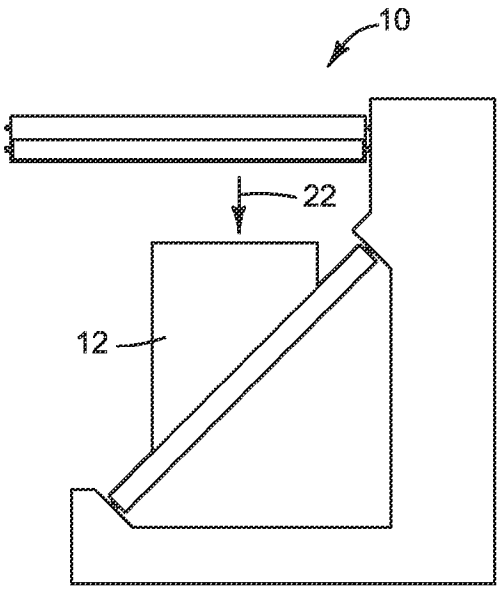
Figure 9E:
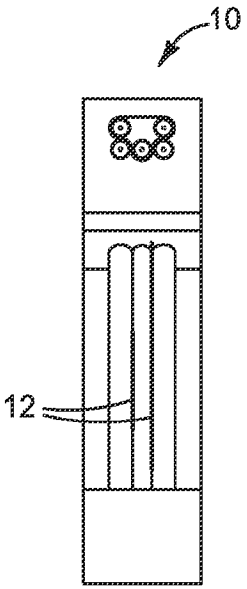
Figure 11E:
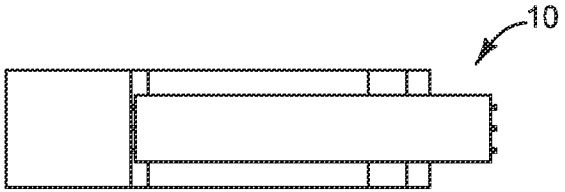
Figure 8E:
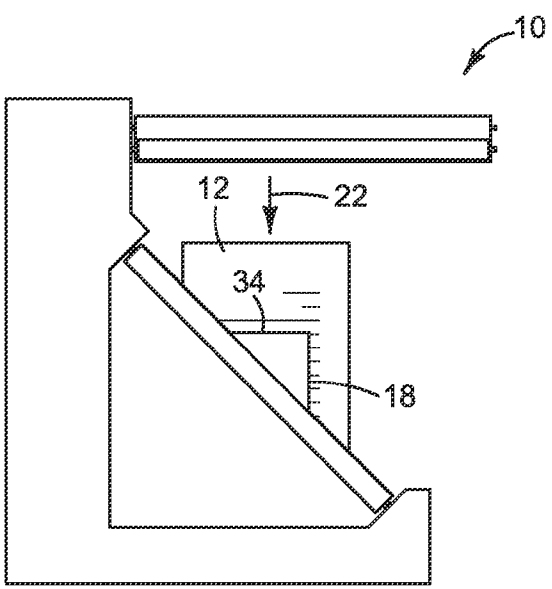
Figure 11F:
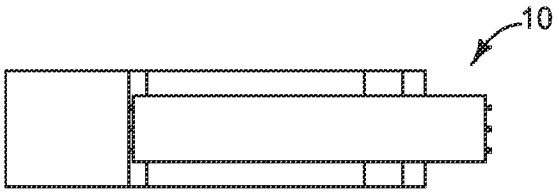
Figure 9F:
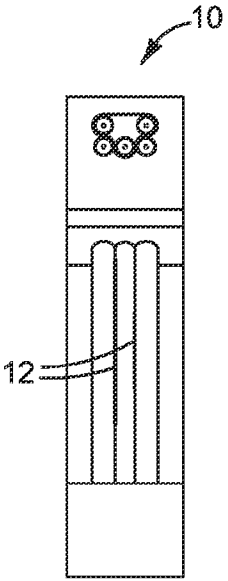
Figure 8F:
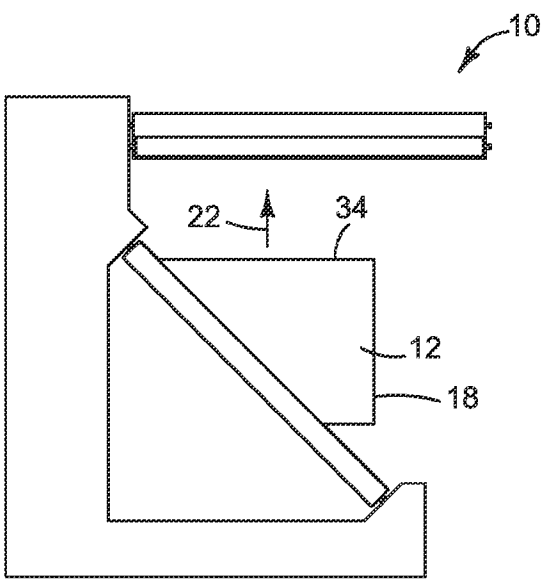
Figure 10F:
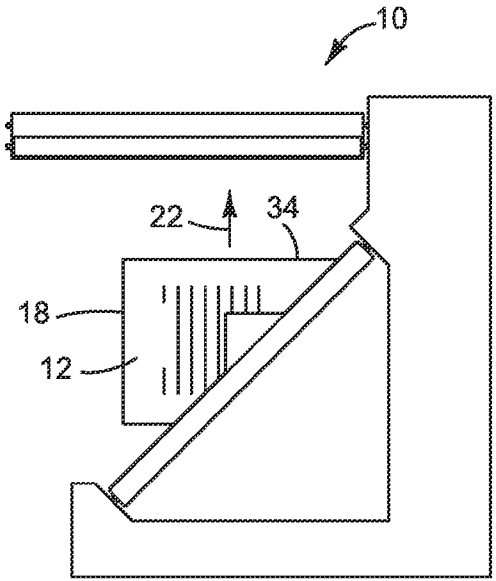
Figure 10G:
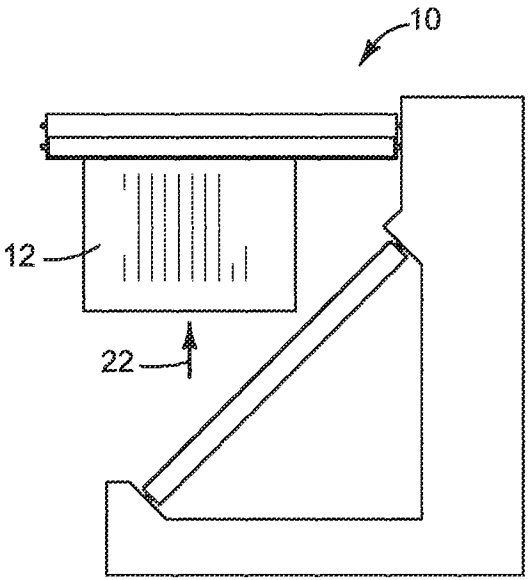
Figure 9G:
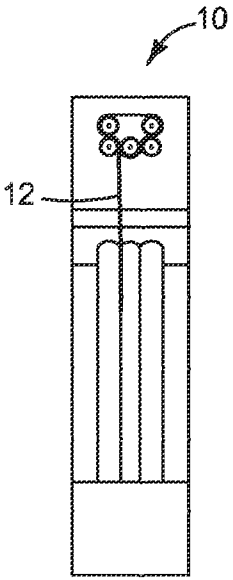
Figure 11G:
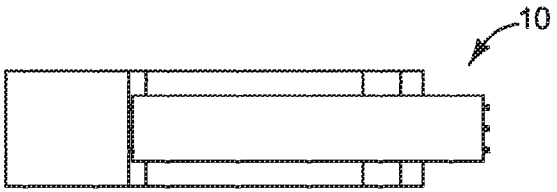
Figure 8G:
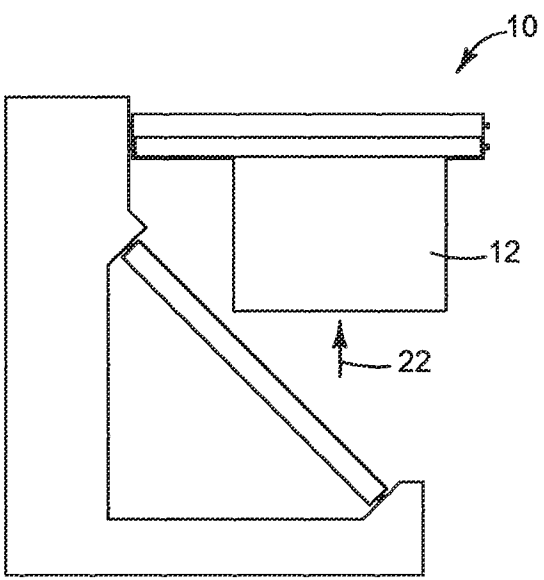
Figure 11H:
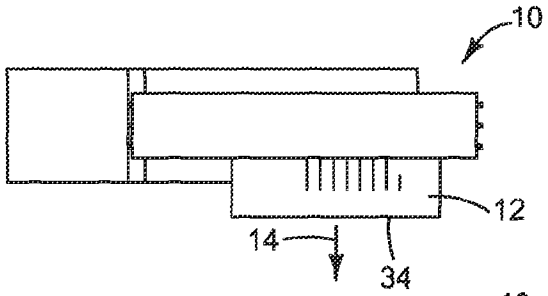
Figure 9H:
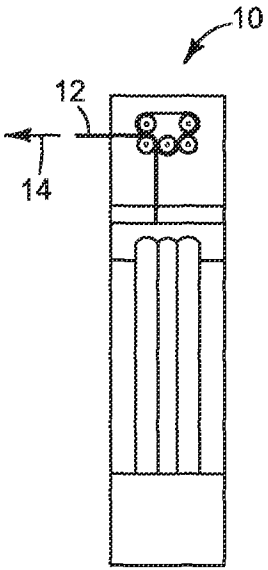
Figure 8H:
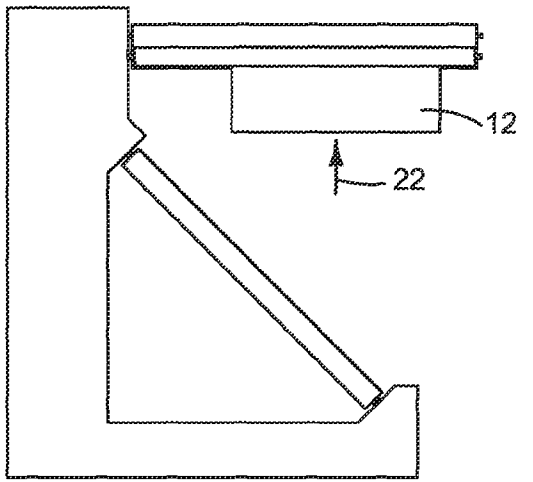
Figure 10H:
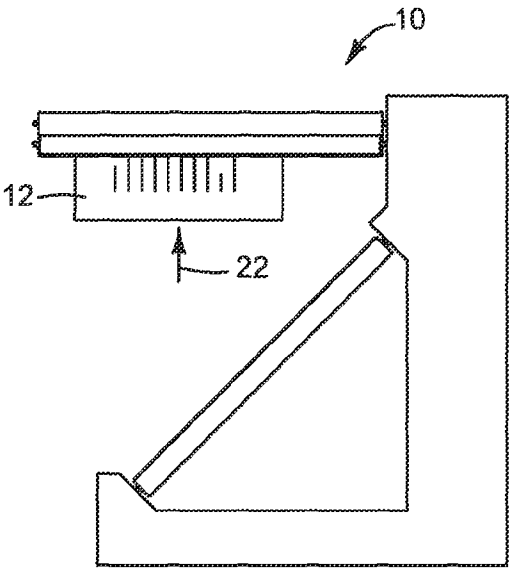
Figure 11I:
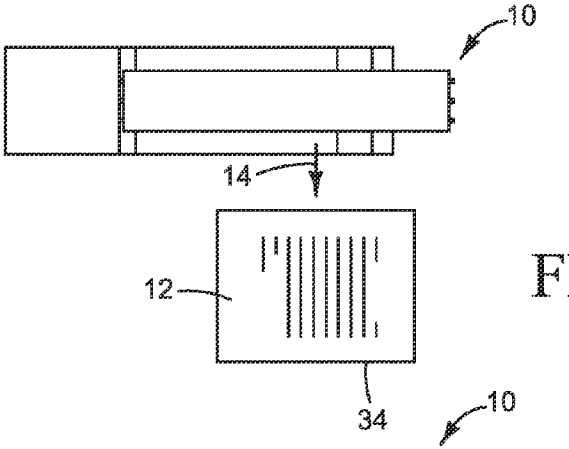
Figure 9I:
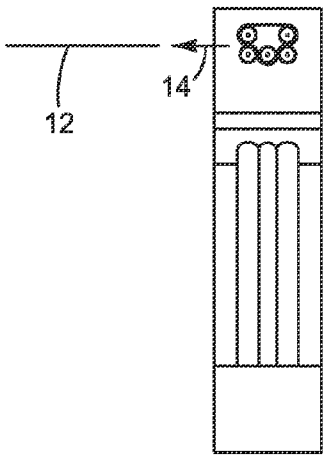
Figure 8I:
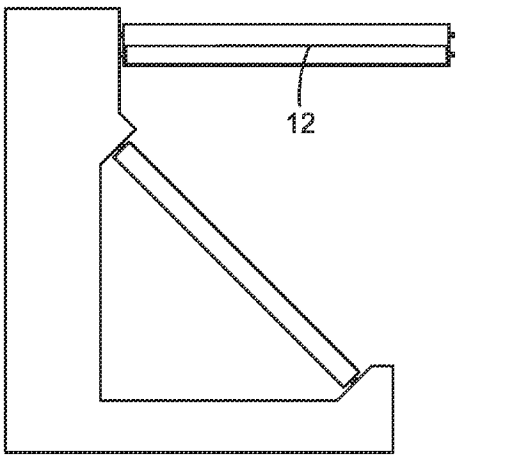
Figure 10I:
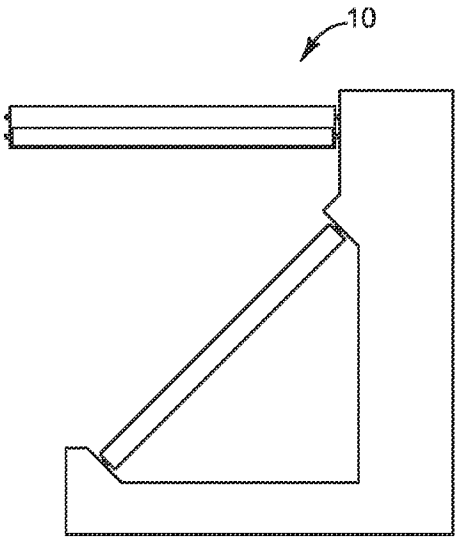

FIG. 1 is a perspective view illustrating a sheet handling device 10 according to one example of the invention. FIGS. 2-4 are front elevation, side elevation, and plan views, respectively, of sheet handling device 10. FIGS. 5 and 6 are section views taken along line 5-5 and line 6-6 in FIG. 1, respectively. Referring first to the plan view of FIG. 4, a rectangular, flexible sheet 12 enters device 10 face-up in a first orientation along a primary sheet path 14 and exits device 10 face-up in a second orientation along primary path 14. In the example shown, sheet 12 enters device 10 in a portrait orientation and exits device 10 in a landscape orientation. The manipulation of sheet 12 by device 10 is described in detail below with reference to the sequence of views shown in FIGS. 7A-7I, 8A-8I, 9A-9I, 10A-10I, and 11A-11I. Reference may be made now to the movement of sheet 12 through device 10 shown in FIGS. 7A-7I preliminary to the following description of the components of device 10.

Throughout this Description, direction and orientation are described with reference to a Cartesian coordinate system in which the X axis extends along primary sheet path 14 through device 10, the Y axis extends perpendicular to the X axis laterally across primary path 14, and the Z axis extends perpendicular to the X and Y axes. In the example shown, the X and Y axes define a horizontal plane. Thus, in this example, sheet 12 is rotated 90° in the X-Y plane along primary sheet path 14.

In the following description of the components of device 10, not all components are clearly visible in all of FIGS. 1-6. Consequently, not all part reference numbers appear in each FIGS. 1-6. Referring to FIGS. 1-6, sheet handling device 10 includes a first turn mechanism 16 configured to redirect/turn a first leading edge 18 of sheet 12 from horizontal primary sheet path 14 downward toward a second turn mechanism 20 along a vertical secondary sheet path 22, as indicated by direction arrows 24 and 26 in FIG. 5, and to move sheet 12 to second turn mechanism 20. Second turn mechanism 20 is configured to rotate/reorient sheet 12 90° and simultaneously redirect/turn sheet 12 upward along secondary sheet path 22 toward a third turn mechanism 28, as indicated by direction arrows 30 and 32 in FIG. 6, and to move sheet 12 to third turn mechanism 28. Third turn mechanism 28 is configured to redirect/turn a second leading edge 34 of sheet 12 to primary sheet path 14, as indicated by direction arrows 36 and 38 in FIG. 5. The reoriented sheet 12 is shown in FIG. 4.

First turn mechanism 16 includes a first trio of rollers 40, 42 and 44 and a first endless loop belt 46 wrapping rollers 40, 42 and 44 to form a first nip 48 between roller 42 and belt 46.

Second turn mechanism 20 includes a second trio of rollers 50, 52 and 54 and a second endless loop belt 56 wrapping rollers 50, 52 and 54 to form a second nip 58 between roller 52 and belt 56. Rollers 50, 52, and 54 in second turn mechanism 20 are positioned below first and third (upper) turn mechanisms 16 and 28 generally in a Y-Z plane and oriented at an angle θ with respect to sheet first leading edge 18 (and the upper turn rollers) in the Y-Z plane. In the example shown, and as described in more detail below, an angle θ (FIG. 3) of 45° allows second (lower) turn mechanism 20 to rotate/reorient sheet 12 90° while simultaneously turning sheet 12 180°.

Third turn mechanism 28 includes a third trio of rollers 44, 60, and 62 and belt 46 wrapping rollers 44, 60, and 62 to form a third nip 64 between roller 60 and belt 46. Thus, in the example shown, first and third (upper) turn mechanisms 16 and 28 are integrated into a single unit, sharing roller 44 and belt 46. Other configurations are possible. For example, first and third turn mechanisms 16 and 28 may be configured as completely discrete assemblies that do not share either a roller or a belt.

As best seen in FIGS. 5 and 6, the exit part of first nip 48 is aligned to the entry part of second nip 58 to help guide first leading edge 18 toward nip 58. Similarly, the exit part of second nip 58 is aligned to the entry part of third nip 64 to help guide second leading edge 34 toward nip 64. External guides (not shown) may also be used to help guide sheet 12 between first and third turn mechanisms 16, 28 and second turn mechanism 20. With continued reference to FIGS. 5 and 6, the degree of turn of sheet 12 at first and third turn mechanisms 16, 28 may be controlled by the wrap of first belt 46 on nip rollers 42 and 60. In the example shown, sheet 12 is turned 90° at first nip 48 and third nip 64. To achieve this turn angle at nips 48 and 64, first belt 46 and the rollers in turn mechanisms 16, 28 are arranged so that belt 46 wraps approximately 25% of the circumference of each nip roller 44 and 60. Similarly, in the example shown, sheet 12 is turned 180° at second nip 58 in second turn mechanism 20. To achieve this turn angle at nip 58, the rollers in second turn mechanism 20 are arranged so that second belt 56 wraps approximately 50% of nip roller 52.

Belt 46 is driven by one or more of rollers 40, 42, 44, 60, 62. Although any of rollers 40, 42, 44, 60, 62 may be used to drive belt 46, and thus serve as a drive roller, it is expected that nip rollers 42 and 60 will usually be configured as idler rollers (non-driven rollers) and one or more of the other rollers 40, 44, 62 will serves as a drive roller. Similarly, belt 56 in second turn mechanism 20 is driven by one or more of rollers 50, 54 while nip roller 52 is configured as an idler roller.

Referring again to FIGS. 1-4, turn mechanisms 16, 20, and 28 are supported in a frame 66. Frame 66 may house one or more motors (not shown) for driving turn mechanisms 16, 20, and 28 and a local controller (not shown) for controlling the operation of each turn mechanism 16, 20, and 28. Parts of frame 66 are cut-away or omitted in some of the figures to better illustrate other features of device 10.

The operation of sheet handling device 10 will now be described with reference to the sequence of views shown in FIGS. 7A-7I, 8A-8I, 9A-9I, 10A-10I, and 11A-11I. FIGS. 7A-7I are perspective views showing sheet 12 moving through device 10. Each of FIGS. 8A-8I, 9A-9I, 10A-10I, and 11A-11I is a series of left side elevation, front elevation, right side elevation and plan views, respectively, showing sheet 12 moving through device 10. The position of sheet 12 in each of FIGS. 8A-8I, 9A-9I, 10A-10I, and 11A-11I corresponds to the position of sheet 12 in the respective FIGS. 7A-7I. For convenience, in the following description of the movement of sheet 12 through device 10 reference is made only to the letter (A, B, C, etc.) of FIGS. 7A-7I, 8A-8I, 9A-9I, 10A-10I, and 11A-11I with the understanding that the letter designates the corresponding view in each set of figures.

The first leading edge 18 of sheet 12 moving horizontally along primary path 14 in a portrait orientation is drawn into first nip 48 and turned 90° down toward second turn mechanism 20, as best seen by comparing views A, B and C. First leading edge 18 now moving vertically along secondary sheet path 22 is drawn into second nip 58 beginning at one corner of sheet 12, as shown in view D. As sheet 12 is drawn through second nip 58, it is turned 180° along secondary path 22 up toward third turn mechanism 28 and simultaneously rotated 90°, as best seen by comparing views E, F and G. Thus, second nip 58 receives sheet 12 along a first leading edge 18 and expels sheet 12 along a second leading edge 34 that is perpendicular to the first leading edge 18 (i.e., the leading edges are along adjacent sides of sheet 12). Second leading edge 34 moving vertically along secondary path 22 is drawn into third nip 64 and turned 90° to continue sheet 12 horizontally along primary sheet path 14 but now in a landscape orientation, as best seen by comparing views G, H, and I.

In another example of a sheet handling device 10, shown in FIG. 12, a series of guides 68, 70, and 72 guide sheet 12 through turn mechanisms 16, 20, and 28. In this example, each pair of adjacent rollers 40/42, 42/44, 44/60, and 60/62 in first and third (upper) turn mechanisms 16 and 28 form respective upper nips 74, 76, 78, and 80. Each pair of adjacent rollers 50/52, and 52/54 in second (lower) turn mechanism 20 forms respective lower nips 82 and 84.

The sequence of movement of the sheet through the example of sheet handling device 10 in FIG. 12 is similar to that shown in views A-I described above. As the sheet is drawn through upper nip 74, for example in a portrait orientation, guide 68 turns the first leading edge down into nip 76 and the sheet is moved down to lower nip 82. As the first leading edge is drawn into nip 82, guide 70 guides the sheet around roller 52 and into the second lower nip 84. As the sheet is drawn around roller 52 through lower nips 82 and 84, it is turned approximately 180° up toward third turn mechanism 28 and simultaneously rotated 90°. Thus, the first lower nip 82 receives the sheet along the first leading edge and the second lower nip 84 expels the sheet along the second leading edge. The sheet is drawn up into upper nip 78, turned by guide 72 into nip 80 and expelled from third turn mechanism 28 to continue horizontally along the primary sheet path but now in a different orientation, for example a landscape orientation.

FIG. 13 is a block diagram illustrating a sheet handling device 10 according to one example of the invention. Referring to FIG. 13, device 10 includes a first turn mechanism 16 configured to receive a flexible sheet moving in a first direction in a first orientation and turn the sheet to a second direction toward a second turn mechanism 20. Second turn mechanism 20 is configured to receive the sheet moving in the second direction, turn the sheet to a third direction toward a third turn mechanism 28 and simultaneously reorient the sheet to a second orientation. Third turn mechanism 28 is configured to receive the reoriented sheet moving in the third direction and turn the sheet to a fourth direction. For example, the second direction is turned 90° from the first direction, the third direction is turned 180° from the second direction, the second orientation is rotated 90° from the first orientation, and the fourth direction is the same as the first direction. For another example, first turn mechanism 16 may include a first trio of rollers 40, 42, 44 wrapped by a belt 46, second turn mechanism 20 may include a second trio of rollers 50, 52, 54 wrapped by a second belt 56, and third turn mechanism 28 may include a third trio of rollers 44, 60, 62 wrapped by belt 46, as described above with reference to FIGS. 1-6.

Still referring to FIG. 13, sheet handling device 10 may also include a motor or set of motors 83 for driving each turn mechanism 16, 20, 28. Device 10 may also include a controller 85 for controlling the operation of motor(s) 83. Sheets may move continuously through sheet handling device 10 without stopping and accelerating, and without delay, at the direction of a local, device controller 85 or at the direction of a system controller where device 10 is integrated into a printer or other sheet processing system. Alternatively, the speed of each sheet moving through device 10 may be varied at the direction of controller 85 as necessary or desirable for integration into a sheet processing system.

FIG. 14 is a block diagram illustrating a printer 86 implementing a sheet handling device 10 according to one example of the invention. Referring to FIG. 14, printer 86 includes a sheet media supply 88, a print engine 90, a sheet stacker or finishing device 92, a sheet media transport 94, and a controller 96. Print engine 90 represents any suitable device for printing on flexible sheets of print media including, for example, an inkjet print engine or an electro-photographic (EP) print engine. Media transport 94 moves sheets from a tray or other supply 88 through print 90 to a stacker or finishing device 92. Media transport 94 includes a sheet handling device 10 configured to reorient sheets output from print engine 90 before reaching finishing device 92. Sheet handling device 10 may be a permanent part of media transport 94, a by-passable component of media transport 94, or a removable component installed into and removed from media transport 94. Controller 96 represents generally the programming, processor and associated memory, and the electronic circuitry and components needed to control the operative elements of printer 86.

FIG. 15 is a perspective view illustrating a printer 86 implementing a sheet handling device 10 according to one example of the invention. Printer 86 in FIG. 15 is depicted as a liquid electro-photographic (LEP) printing press. Referring to FIG. 15, printer 86 includes a sheet media supply 88 with multiple media trays that may hold, for example, different types or sizes of media sheets 12. Printer 86 also includes an LEP print engine 90, sheet stacker 92, media transport 94 with sheet handling device 10, and a control system 96. Sheets of paper or other print media are fed from a stack in supply 88 across a feed bridge to print engine 90 from which they emerge as printed sheets 12 conveyed along a primary path 14, ultimately to stacker 92.

Print engine 90 includes a charging device 100 located adjacent to a photoconductor 102 for applying a uniform electric charge to photoconductor 102. A photo imaging device 104 exposes selected areas on photoconductor 102 to light in the pattern of the desired printed image. A thin layer of liquid toner is applied to the patterned photoconductor 102 through one or more of a series of developer units 106 to develop the latent image on photoconductor 102 into a toner image. Each developer unit 106 usually applies a different color ink from a corresponding series of toner supplies 108. The toner image is transferred from photoconductor 102 to an intermediate transfer member 110 and then to sheets 12 as they pass through a nip between intermediate transfer member 110 and a pressure roller 112.

Printed sheets 12 may be routed through sheet handling device 10 to change the orientation of each sheet 12, from portrait to landscape, for example, as described above with reference to FIGS. 7A-7I, before moving to stacker 92. The vertical configuration of sheet handling device 10 in printer 86 allows each sheet 12 to be re-oriented along a vertical secondary sheet path (FIGS. 7A-7I) to help minimize the footprint of printer 86.

The examples shown in the Figures and described above do not limit the invention. Other examples are possible. Accordingly, these and other examples, implementations, configurations and details may be made without departing from the spirit and scope of the invention, which is defined in the following claims.

What is claimed is:

1. A sheet handling device, comprising:

a first mechanism configured to receive a flexible sheet moving in a first direction in a first orientation and turn the sheet to a second direction;

a second mechanism configured to receive the sheet moving in the second direction, turn the sheet to a third direction and simultaneously reorient the sheet to a second orientation;

a third mechanism configured to receive the reoriented sheet moving in the third direction and turn the sheet to a fourth direction; and the first mechanism, the second mechanism and the third mechanism are configured with respect to one another so that a sheet received face-up in the first mechanism is expelled face-up from the third mechanism.

2. The device of claim 1, wherein the third direction is opposite the second direction and the second orientation is rotated 90° from the first orientation.

3. The device of claim 1, wherein:

the second direction is turned 90° from the first direction;

the third direction is turned 180° from the second direction;

the second orientation is rotated 90° from the first orientation; and the fourth direction is the same as the first direction.

4. The device of claim 3, wherein the first and fourth directions are horizontal, the second direction is vertically downward, and the third direction is vertically upward.

5. The device of claim 1, wherein the second mechanism comprises a trio of elongated rollers and an endless loop belt wrapping the trio of rollers to form a nip between the belt and one of the rollers for receiving a first leading edge of the sheet in the second direction and expelling a second leading edge of the sheet in the third direction.

6. The device of claim 1, wherein the second mechanism comprises:

a trio of elongated rollers arranged next to one another to form a first nip between a first pair of adjacent rollers for receiving a first leading edge of the sheet in the second direction and to form a second nip between a second pair of adjacent rollers for expelling a second leading edge of the sheet in the third direction; and a sheet guide positioned between the nips and configured to guide the sheet from the first nip into the second nip.

7. The device of claim 1, wherein:

the first mechanism comprises a first trio of elongated rollers and a first endless loop belt wrapping the first trio of rollers to form a first nip between the first belt and one of the first rollers for receiving a first leading edge of the sheet in the first direction and expelling the first leading edge in the second direction;

the second mechanism comprises a second trio of elongated rollers and a second endless loop belt wrapping the second trio of rollers to form a second nip between the second belt and one of the second rollers for receiving the first leading edge of the sheet in the second direction and expelling a second leading edge of the sheet in the third direction; and the third mechanism comprises a third trio of elongated rollers and a third endless loop belt wrapping the third trio of rollers to form a third nip between the third belt and one of the third rollers for receiving the second leading edge of the sheet in the third direction and expelling the second leading edge in the fourth direction.

8. The device of claim 7, wherein:

the first trio of rollers in the first mechanism shares a roller with the third trio of rollers in the third mechanism; and the first endless loop belt and third endless loop belt together comprise a single endless loop belt wrapping all five rollers in the two trios of rollers.

9. A sheet handling device, comprising;

a trio of elongated rollers; and an endless loop belt wrapping the rollers to form a nip between the belt and one of the rollers, the nip for receiving a first leading edge of a sheet moving in a first direction along a sheet path and expelling a second leading edge of the sheet in a second direction opposite the first direction, the second leading edge of the sheet perpendicular to the first leading edge the sheet;

the trio of rollers spanning the sheet path and angled relative to the sheet path such that the nip receives the first leading edge beginning at a corner of the sheet and progressing across the first leading edge and the nip expels the second leading edge beginning at the corner of the sheet and progressing across the second leading.

10. The device of claim 9, wherein the trio of rollers spans the sheet path at a 45° angle to simultaneously turn the sheet 180° from the first direction to the second direction and rotate the sheet 90° from the first leading edge to the second leading edge.

11. A printer, comprising:

a print engine configured to print on flexible sheets of print media;

a sheet handling device including:

a first mechanism configured to receive a printed sheet moving in a first direction in a first orientation along a primary sheet path and turn the sheet to a second direction along a secondary sheet path, a second mechanism configured to receive the sheet moving in the second direction, turn the sheet to a third direction along the secondary sheet path and simultaneously reorient the sheet to the second orientation, and a third mechanism configured to receive the reoriented sheet moving in the third direction and return the reoriented sheet to the first direction along the primary sheet path; and the third direction is opposite the second direction and the second orientation is rotated 90° from the first orientation; and a controller configured to control operative elements of the print engine and the sheet handling device.

12. The printer of claim 11, wherein the primary sheet path is horizontal and the secondary sheet path is vertical.

13. The device of claim 11, wherein the first direction is horizontal, the second direction is vertically downward, and the third direction is vertically upward.

14. The device of claim 11, wherein the first mechanism, the second mechanism and the third mechanism are configured with respect to one another so that a sheet received face-up in the first mechanism is expelled face-up from the third mechanism.

15. The device of claim 11, wherein the second mechanism comprises a trio of elongated rollers and an endless loop belt wrapping the trio of rollers to form a nip between the belt and one of the rollers for receiving a first leading edge of the sheet in the second direction and expelling a second leading edge of the sheet in the third direction.

16. The device of claim 11, wherein the second mechanism comprises:

a trio of elongated rollers arranged next to one another to form a first nip between a first pair of adjacent rollers for receiving a first leading edge of the sheet in the second direction and to form a second nip between a second pair of adjacent rollers for expelling a second leading edge of the sheet in the third direction; and a sheet guide positioned between the nips and configured to guide the sheet from the first nip into the second nip.

17. The device of claim 11, wherein:

the first mechanism comprises a first trio of elongated rollers and a first endless loop belt wrapping the first trio of rollers to form a first nip between the first belt and one of the first rollers for receiving a first leading edge of the sheet in the first direction and expelling the first leading edge in the second direction;

the second mechanism comprises a second trio of elongated rollers and a second endless loop belt wrapping the second trio of rollers to form a second nip between the second belt and one of the second rollers for receiving the first leading edge of the sheet in the second direction and expelling a second leading edge of the sheet in the third direction; and the third mechanism comprises a third trio of elongated rollers and a third endless loop belt wrapping the third trio of rollers to form a third nip between the third belt and one of the third rollers for receiving the second leading edge of the sheet in the third direction and expelling the second leading edge in the first direction.

* * * * *

UNITED STATES PATENT AND TRADEMARK OFFICE

CERTIFICATE OF CORRECTION

PATENT NO. : 8,196,921 B1
APPLICATION NO. : 13/015659
DATED : June 12, 2012
INVENTOR(S) : Shamai Opfer et al.

It is certified that error appears in the above-identified patent and that said Letters Patent is hereby corrected as shown below:

In column 7, line 24, in Claim 9, after "edge" insert -- of --.

Signed and Sealed this
Nineteenth Day of February, 2013

Teresa Stanek Rea
*Acting Director of the United States Patent and Trademark Office*